US012491550B2

(12) United States Patent
Sugimoto et al.

(10) Patent No.: US 12,491,550 B2
(45) Date of Patent: Dec. 9, 2025

(54) HOT ROLLING MILLS AND HOT ROLLING METHODS

(71) Applicant: PRIMETALS TECHNOLOGIES JAPAN, LTD., Hiroshima (JP)

(72) Inventors: Tatsunori Sugimoto, Hiroshima (JP); Kenji Horii, Hiroshima (JP); Akio Kuroda, Hiroshima (JP); Akira Sako, Hiroshima (JP); Shinya Kanemori, Tokyo (JP)

(73) Assignee: PRIMETALS TECHNOLOGIES JAPAN, LTD., Hiroshima (JP)

( * ) Notice: Subject to any disclaimer, the term of this patent is extended or adjusted under 35 U.S.C. 154(b) by 414 days.

(21) Appl. No.: 17/914,778

(22) PCT Filed: Apr. 27, 2020

(86) PCT No.: PCT/JP2020/018021

§ 371 (c)(1),
(2) Date: Sep. 27, 2022

(87) PCT Pub. No.: WO2021/220366

PCT Pub. Date: Nov. 4, 2021

(65) Prior Publication Data

US 2023/0149995 A1 May 18, 2023

(51) Int. Cl.
*B21B 37/58* (2006.01)

(52) U.S. Cl.
CPC ..... *B21B 37/58* (2013.01)

(58) Field of Classification Search
CPC ..... B21B 13/023; B21B 2013/025; B21B 13/145; B21B 37/58; B21B 38/08
See application file for complete search history.

(56) References Cited

U.S. PATENT DOCUMENTS 6,266,988 B1 * 7/2001 Kimura ..... B21B 13/023 72/241.4

FOREIGN PATENT DOCUMENTS

| | | | |
|---|---|---|---|
| CA | 2350534 | A1 | 5/2000 |
| JP | 06-198307 | A | 7/1994 |
| JP | 09-220608 | A | 8/1997 |

(Continued)

OTHER PUBLICATIONS

DE 10102307A, Scholl et al. Aug. 2002.*

(Continued)

*Primary Examiner* — Edward T Tolan
(74) *Attorney, Agent, or Firm* — MATTINGLY & MALUR, PC

(57) ABSTRACT

Angles of an upper-side pair of an upper work roll 110A and an upper backup roll 120A, and a lower-side pair of a lower work roll 110B and a lower backup roll 120B are adjusted in a state where the upper-side pair is kept parallel and in a state where the lower-side pair is kept parallel. Thereafter, work-roll pressing apparatuses 130A and 130B, work-roll position control apparatuses 140A and 140B, backup-roll pressing apparatuses 150A and 150B, and backup-roll position control apparatuses 160A and 160B are controlled such that the angles of the upper work roll 110A and the lower work roll 110B are adjusted in a state where the angles of the upper backup roll 120A and the lower backup roll 120B are maintained.

8 Claims, 18 Drawing Sheets

(56) References Cited

FOREIGN PATENT DOCUMENTS

| | | | |
|---|---|---|---|
| JP | 2002-529250 | A | 9/2002 |
| JP | 2015-93294 | A | 5/2015 |

OTHER PUBLICATIONS

JP 57-190704A, Mito et al. Nov. 1982.*
JP 59-137104A, Kawanami et al. Aug. 1984.*
JP 04-162904A, Matsuda et al. Oct. 1990.*
JP 05-76915A, Ogawa et al. Mar. 1993.*
JP 08-197110A, Imai Aug. 1996.*
JP 08-294713A, Nishibayashi et al. Nov. 1996.*
International Search Report of PCT/JP2020/018021 dated Jun. 30, 20220.
Korean Office Action received in corresponding Korean Application No. 10-2022-7034421 dated Dec. 2, 2024.

* cited by examiner

HOT ROLLING MILLS AND HOT ROLLING METHODS

TECHNICAL FIELD

The present invention relates to hot rolling mills and hot rolling methods.

BACKGROUND ART

Patent Document 1 discloses a rolling mill that includes an upper work roll, an upper backup roll, a lower work roll, a lower backup roll, and cross angle adjustment mechanisms each of which is provided in association with a corresponding one of the rolls, and each cross angle adjustment mechanism moves a roll chock by relatively moving pistons.

PRIOR ART DOCUMENT

Patent Document

Patent Document 1: JP h9-220608-A

SUMMARY OF THE INVENTION

Problems to be Solved by the Invention

Roll-cross four-high rolling mills that control the strip crown and the strip shape by causing upper and lower rolls to cross each other are generally classified into pair cross mills that change the cross angle of work rolls along with backup rolls, and work roll mills that form a cross angle only between work rolls. These two types have been developed, and it is known that these types allow wide control ranges.

Among them, pair cross mills have a problem that shape control cannot be performed with high responses because the cross angle of backup rolls also is changed.

In contrast, in work-roll crossing, inclination-subjects have a weight which is by far smaller than that in pair crossing, and thus can be inclined quickly (with high responsiveness). In terms only of responsiveness, preferably, only work-roll crossing is used to increase the cross angle to enable crown control.

However, there is a problem about work-roll crossing that thrust forces (forces acting in the axial direction) between backup rolls and work rolls increase as the cross angle increases, thus it is hard to adopt work-roll crossing for small-diameter work rolls.

On the other hand, there is a demand for a technology that enables rolling of a hard steel strip (e.g. an ultrahigh strength steel) or the like that is hard to be rolled as compared with conventional technologies, and also enables reduction of a work-roll diameter to lower the rolling load in order to avoid a size increase (manufacturing-cost increase) of rolling mills.

Here, in Patent Document 1 mentioned above, a description is made that a combination of a work-roll crossing method and a pair roll crossing method allows complicated shape control in the strip-width direction. In Patent Document 1, further, a description is made that complicated shape control can be achieved by generating high-order components by a pair crossing method, and then by combining a simple crossing method therewith, in which a second-order component is the main component.

However, as a result of vigorous examination by the present inventors, it has become clear that it is not possible to specifically solve a problem of enabling rolling of a hard steel strip while making it easy to adopt small-diameter work rolls, widening control ranges, and ensuring also responsiveness.

More specifically, the description of Patent Document 1 does not solve a problem of excessive thrust forces being generated in work-roll crossing, and it is hard to adopt small-diameter work rolls. In addition, despite the description of Patent Document 1, it has become clear that not only control by work-roll cross mills but control by pair cross mills also is close to shape control of a second-order component, and a problem has become clear that controllability of so-called quarter buckles in which buckles are generated at widthwise ¼-positions is not sufficient.

That is, through examination by the present inventors, it has become clear that adopting small-diameter work rolls is difficult due to excessive thrust forces, and that the fourth-order component shape control capability is low.

The present invention provides hot rolling mills and hot rolling methods that can ensure wide control ranges and responsiveness as compared with conventional technologies.

Means for Solving the Problems

The present invention includes plurality of means for solving the problems described above, and an example thereof is a hot rolling mill in which angles of an upper-side pair of an upper work roll and an upper backup roll, and a lower-side pair of a lower work roll and a lower backup roll are adjusted in a state where the upper-side pair is kept parallel and in a state where the lower-side pair is kept parallel, and thereafter work-roll horizontal actuators and backup-roll horizontal actuators are controlled such that the angles of the upper work roll and the lower work roll are adjusted in a state where the angles of the upper backup roll and the lower backup roll are maintained.

Advantages of the Invention

According to the present invention, it is possible to ensure wide control ranges and responsiveness as compared with conventional technologies. Problems, configurations, and advantages other than those described above are made clear by the following explanation of embodiments.

MODES FOR CARRYING OUT THE INVENTION

Figure 1:
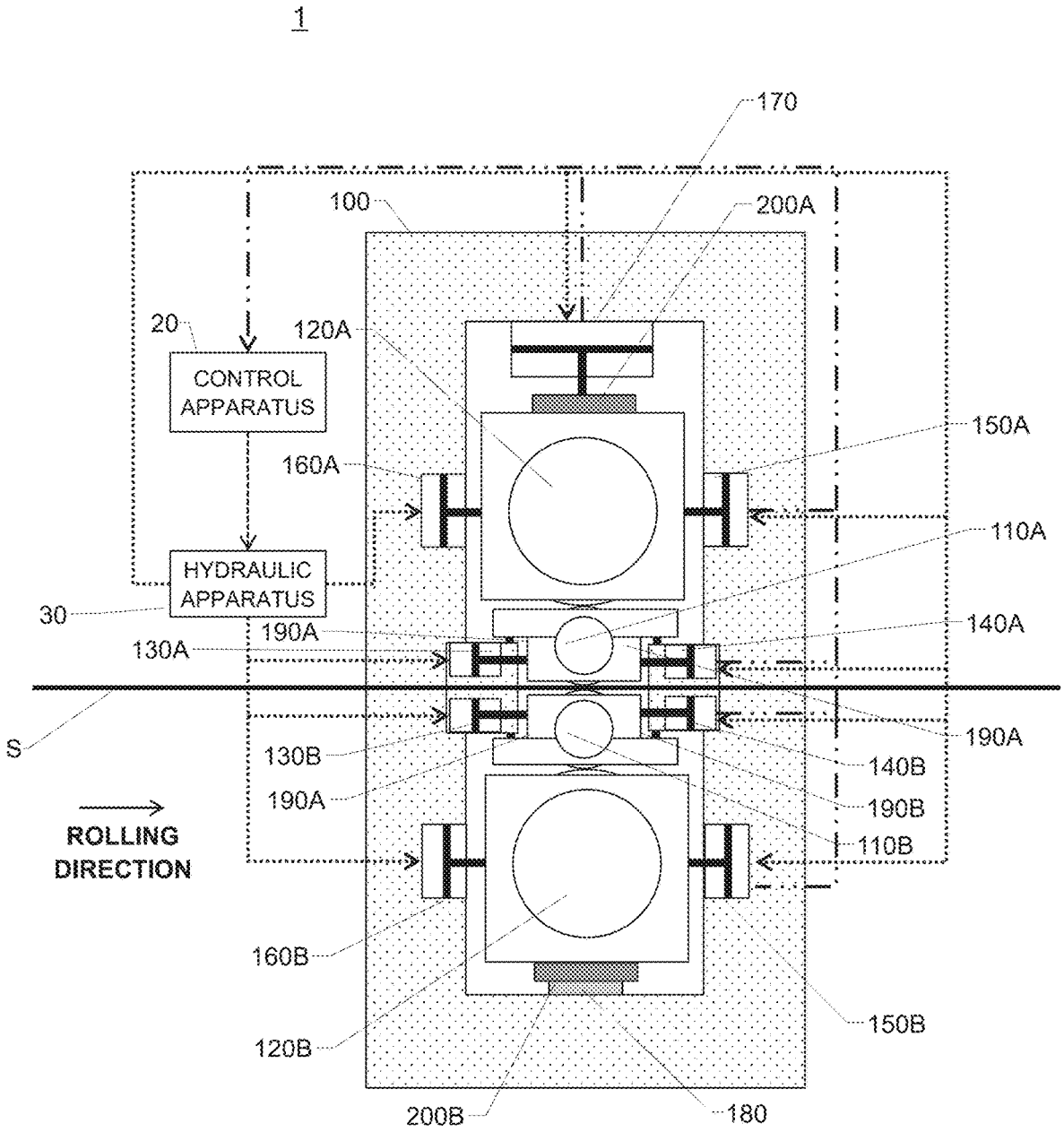
FIG. 1 is a side view depicting the apparatus configuration of a rolling mill according to a first embodiment of the present invention.

Embodiments of hot rolling mills and hot rolling methods according to the present invention are explained below by using the figures.

Note that identical or corresponding constituent elements in the figures used in the present specification are given identical or similar reference characters, and repetitive explanations of these constituent elements are omitted in some cases.

In addition, in the following embodiments and figures, a drive side (also written as a "DS (Drive Side)") means a side where electric motors to drive work rolls are installed when a rolling mill is seen from its front side, and a work side ("WS (Work Side)") means the opposite side.

First Embodiment

A first embodiment of hot rolling mills and hot rolling methods according to the present invention is explained by using FIG. 1 to FIG. 4.

Figure 2:
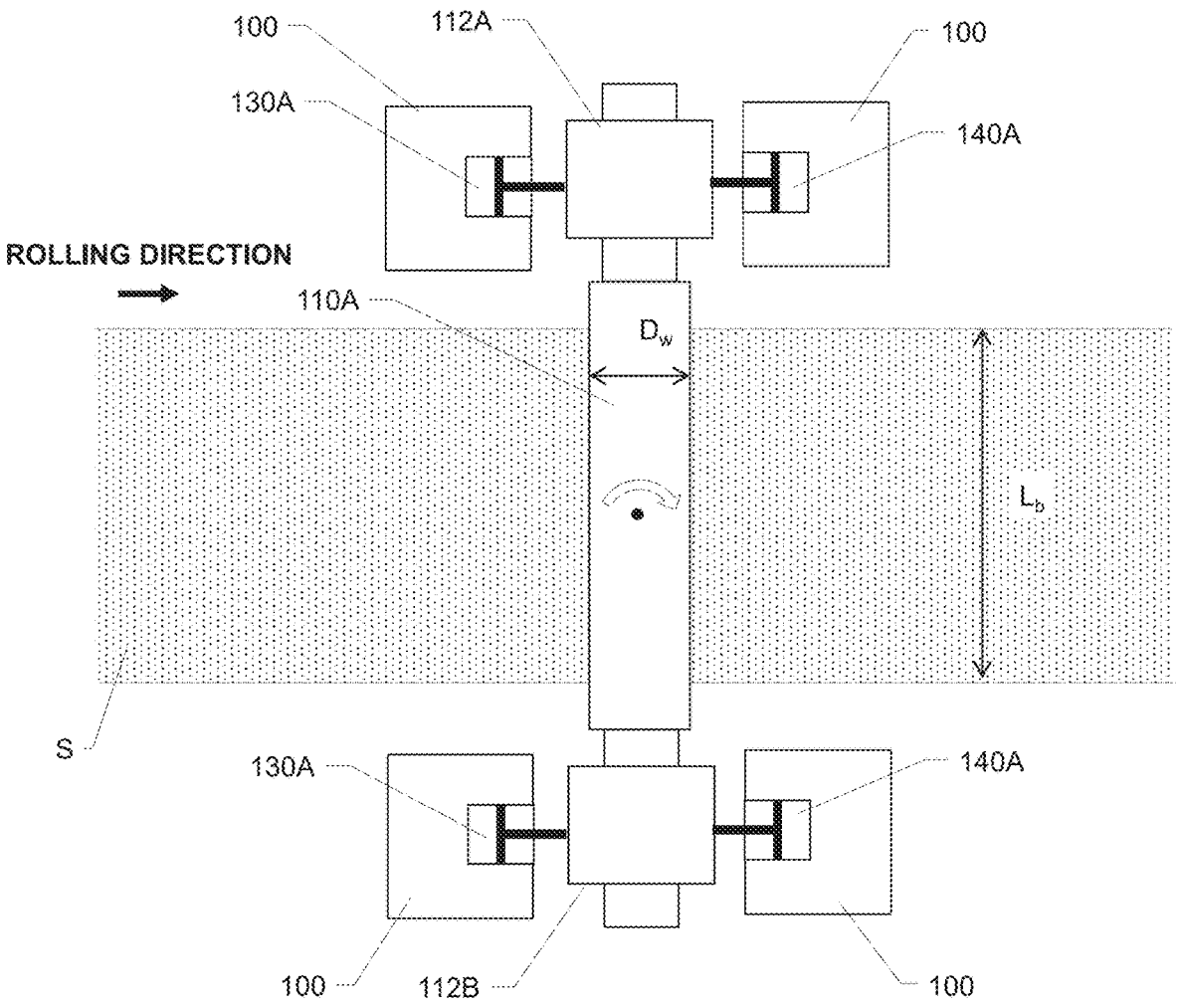
FIG. 2 is a top view depicting an overview of the configuration of equipment around an upper work roll in the rolling mill depicted in FIG. 1.

First, the overall configuration of a hot rolling mill is explained by using FIG. 1 and FIG. 2. FIG. 1 is a side view of the rolling mill according to the present embodiment, and FIG. 2 is a top view depicting an overview of the configuration of equipment around an upper work roll in the rolling mill depicted in FIG. 1.

In FIG. 1, a hot rolling mill 1 is a Roll-cross four-high rolling mills that rolls a rolled material S, and has a housing 100, a control apparatus 20, and a hydraulic apparatus 30. Note that the rolling mill is not limited to a one-stand rolling mill like the one depicted in FIG. 1, and may be a rolling mill including two stands or more.

The housing 100 includes a pair of an upper work roll 110A and a lower work roll 110B that are provided on the upper side and lower side, a pair of an upper backup roll 120A and a lower backup roll 120B that support the work rolls 110A and 110B, and are provided on the upper side and lower side.

Hydraulic cylinder apparatuses 170 are cylinders that apply rolling forces to the upper backup roll 120A, the upper work roll 110A, the lower work roll 110B, and the lower backup roll 120B by pressing the upper backup roll 120A. The hydraulic cylinder apparatuses 170 are provided on the work side and drive side of the housing 100.

A load cell 180 is provided at a lower portion of the housing 100, as rolling force measurement means for measuring a rolling force on the rolled material S applied by the work rolls 110A and 110B, and outputs measurement results to the control apparatus 20.

Upper work-roll bending cylinders 190A are provided on the entry side and exit side of the housing 100 on each of the work side and the drive side. By being driven as appropriate, the upper work-roll bending cylinders 190A apply bending forces vertically to bearings of the upper work roll 110A.

Similarly, lower work-roll bending cylinders 190B are provided on the entry side and exit side of the housing 100 on each of the work side and the drive side, and by being driven as appropriate, the lower work-roll bending cylinders 190B apply bending forces vertically to bearings of the lower work roll 110B.

A backup-roll sliding apparatus 200A is provided at a portion vertically above the upper backup roll 120A, and a backup-roll sliding apparatus 200B is provided at a portion vertically below the lower backup roll 120B.

The hydraulic apparatus 30 is connected to hydraulic cylinders of work-roll pressing apparatuses 130A and 130B and work-roll position control apparatuses 140A and 140B, to hydraulic cylinders of backup-roll pressing apparatuses 150A and 150B and backup-roll position control apparatuses 160A and 160B, and furthermore to the work-roll bending cylinders 190A and 190B also. Note that parts of communication lines and hydraulic-fluid supply lines are omitted in FIG. 1 for convenience of illustration. The same applies also to the following figures.

The control apparatus 20 receives input of measurement signals from the load cell 180 and position measuring instruments of the work-roll position control apparatuses 140A and 140B and backup-roll position control apparatuses 160A and 160B.

The control apparatus 20 actuation-controls the hydraulic apparatus 30, and supplies and discharges a hydraulic fluid to and from the hydraulic cylinders of the work-roll pressing apparatuses 130A and 130B and work-roll position control apparatuses 140A and 140B to thereby control actuation of the work-roll pressing apparatuses 130A and 130B and the work-roll position control apparatuses 140A and 140B.

Similarly, the control apparatus 20 actuation-controls the hydraulic apparatus 30, and supplies and discharges a hydraulic fluid to and from the hydraulic cylinders of the backup-roll pressing apparatuses 150A and 150B and backup-roll position control apparatuses 160A and 160B to thereby control actuation of the backup-roll pressing apparatuses 150A and 150B and the backup-roll position control apparatuses 160A and 160B.

Due to the actuation control, the control apparatus 20 controls angle adjustment by the work-roll pressing apparatuses 130A and 130B and work-roll position control apparatuses 140A and 140B, and angle adjustment by the backup-roll pressing apparatuses 150A and 150B and backup-roll position control apparatuses 160A and 160B. Details of the angle adjustment by the control apparatus 20 according to the present embodiment are mentioned later.

Furthermore, the control apparatus 20 supplies and discharges a hydraulic fluid to and from the work-roll bending cylinders 190A and 190B to thereby control actuation of the work-roll bending cylinders 190A and 190B.

Next, configuration related to the upper work roll 110A is explained by using FIG. 2. Note that since the upper backup roll 120A, the lower work roll 110B, and the lower backup roll 120B also have configuration equivalent to the configuration of the upper work roll 110A, and detailed explanations thereof are approximately the same as the explanation about the upper work roll 110A, the explanations thereof are omitted.

As depicted in FIG. 2, there is the housing 100 on both end sides of the upper work roll 110A of the hot rolling mill 1, and is provided to stand perpendicular to the roll shaft of the upper work roll 110A.

The upper work roll 110A is rotatably supported by the housing 100 via a work-side roll chock 112A and a drive-side roll chock 112B.

A work-roll pressing apparatus 130A, on each of the work side and the drive side, is arranged between the entry side of the housing 100 and the work-side roll chock 112A or the drive-side roll chock 112B, and presses the work-side roll chock 112A or the drive-side roll chock 112B of the upper work roll 110A in the rolling direction at a predetermined pressure.

A work-roll position control apparatus 140A, on each of the work side and the drive side, is arranged between the exit side of the housing 100 and the work-side roll chock 112A or the drive-side roll chock 112B, and has a hydraulic cylinder (pressing apparatus) that presses the work-side roll chock 112A or the drive-side roll chock 112B of the upper work roll 110A in the direction opposite to the rolling direction. The work-roll position control apparatus 140A includes a position measuring instrument (illustration omitted) that measures the amount of operation of the hydraulic cylinder, and controls the position of the hydraulic cylinder.

Here, a home-position control apparatus means the apparatus that measures the oil column position of a hydraulic cylinder as a pressing apparatus by using a position measuring instrument incorporated in the home-position control apparatus, and controls the oil column position until the oil column reaches a predetermined oil column position.

These work-roll pressing apparatuses 130A and 130B, backup-roll pressing apparatuses 150A and 150B, and home-position control apparatuses 140A, 140B, 160A, and 160B play a role of an angle adjustor that adjusts the roll cross angle.

Note that whereas FIG. 1 and FIG. 2 depict an example in which hydraulic apparatuses are used as the work-roll position control apparatuses 140A and 140B and the backup-roll position control apparatuses 160A and 160B which are actuators of crossing apparatuses, they are not limited to hydraulic apparatuses, and apparatus with electric configuration or the like can be used.

In addition, whereas the pressing apparatuses are disposed on the entry side of the rolled material S, and the home-position control apparatuses are disposed on the exit side of the rolled material S in the depicted mode, they may be disposed on the opposite sides in some cases, and the arrangement is not limited to a pattern depicted in FIG. 1 and the like.

Furthermore, whereas FIG. 1 and FIG. 2 depict an example in which the pressing apparatuses are provided opposite the home-position control apparatuses, this is not essential, and only the home-position control apparatuses are provided in other possible configuration. It should be noted that installation of the pressing apparatuses makes it possible to eliminate backlashes between the roll chocks 112A and 112B and the home-position control apparatuses, and to stabilize the positions of the roll chocks 112A and 112B in the rolling direction.

Figure 3:
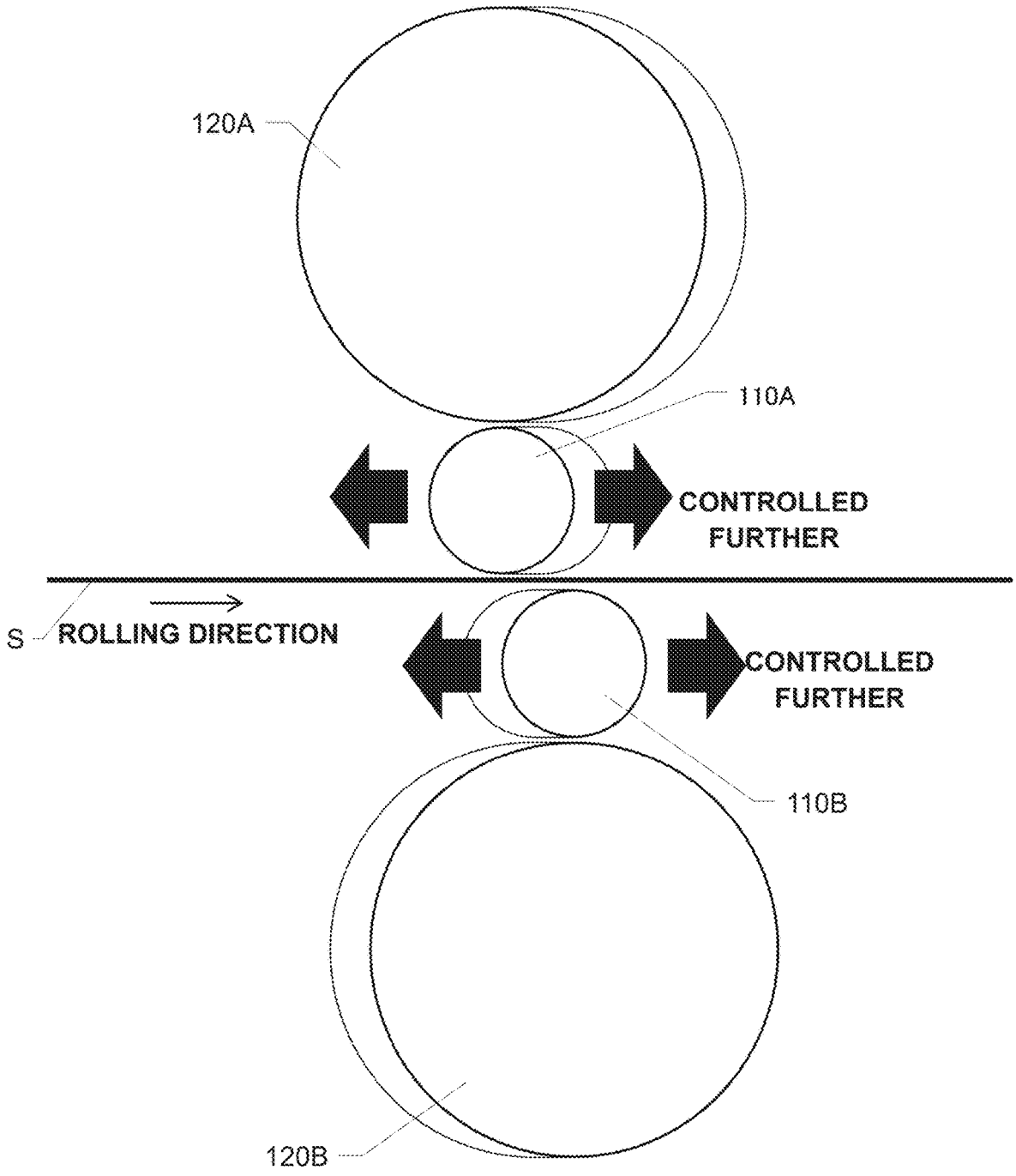
FIG. 3 is a schematic view of a change in the work-roll cross angle during rolling in the rolling mill according to the first embodiment.
Figure 4:
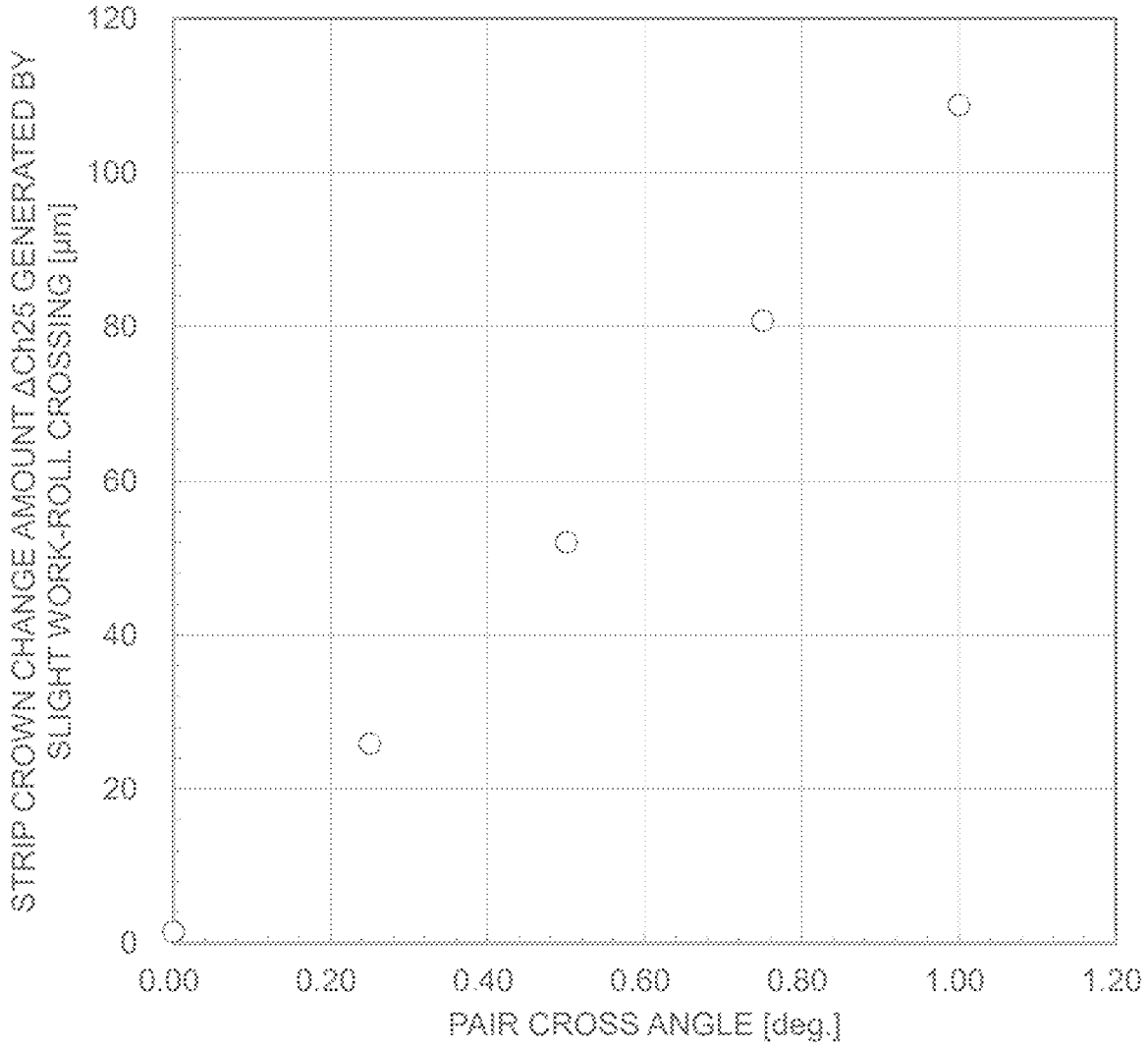
FIG. 4 is a figure depicting strip crown change amounts that are observed when work rolls in a pair-cross state are caused to slight-cross in the rolling mill according to the first embodiment.

Next, a method of cross angle adjustment at a time of rolling in the rolling mill according to the present embodiment is explained with reference to FIG. 3 and FIG. 4. FIG. 3 is a schematic view of a change in the work-roll cross angle during rolling. FIG. 4 is a figure depicting strip crown change amounts that are observed when work rolls in a pair-cross state are caused to slight-cross.

The control apparatus 20 according to the present embodiment adjusts angles of an upper-side pair of the upper work roll 110A and the upper backup roll 120A, and a lower-side pair of the lower work roll 110B and the lower backup roll 120B in a state where the upper-side pair is kept parallel and in a state where the lower-side pair is kept parallel.

Furthermore, thereafter, the control apparatus 20 adjusts angles of the upper work roll 110A and the lower work roll 110B in a state where angles of the upper backup roll 120A and the lower backup roll 120B are maintained.

As adjustment angles at that time, for example, the cross angle between the upper-side pair and the lower-side pair can be made equal to or greater than 0.2 degrees.

This has been found out on the basis of findings like the ones mentioned below.

Thrust forces are generated by relative speed differences between the rolled material S and the work rolls 110A and 110B, and relative speed differences between the work rolls 110A and 110B and the backup rolls 120A and 120B.

Because of this, as the cross angle of the work rolls 110A and 110B increases, thrust forces between the rolled material S and the work rolls 110A and 110B increase, and similarly, as the relative angles between the work rolls 110A and 110B and the backup rolls 120A and 120B increase, thrust forces between the work rolls 110A and 110B and the backup rolls 120A and 120B increase also.

In addition, it has been known that in a case of work-roll crossing, thrust forces acting between the work rolls 110A and 110B and the backup rolls 120A and 120B are greater than thrust forces acting between the rolled material S and the work rolls 110A and 110B.

In view of this, the present inventors have come up with an idea of causing the work rolls 110A and 110B to further slight-cross (e.g. at an angle equal to or smaller than 0.1°) suitably from a pair-cross state as depicted in FIG. 3.

FIG. 4 depicts results of simulations of change amounts ΔCh25 of strip crown Ch25 in a case where work-roll slight crossing of ±0.05° is performed from predetermined pair cross angles in the hot rolling mill 1 depicted in FIG. 1 under the rolling condition that a rolled material with hardness of 20 kgf/mm$^2$ is 20% rolling reduction ratio into a 2-mm strip. The work-roll diameter is 450 mm, and the maximum strip width is 1880 mm.

As depicted in FIG. 4, it has become clear that, for the same changes of ±0.05° in the work-roll slight cross angle, the control range of the work-roll slight cross angle is wider for a change from a greater pair cross angle.

For example, it has become clear that, in FIG. 4, in a case where slight-crossing of the work rolls relative to the backup rolls is performed within the range of ±0.05° from a state where the pair cross angle is 0°, ΔCh25 is as small as 1.5 μm; on the contrary, in a case where slight-crossing of the work rolls relative to the backup rolls is performed within the range of ±0.05° from a state where the pair cross angle is 0.2°, ΔCh25 is 20 μm, which is ten times or more greater.

In view of this, it has become clear also that it is desirable if a pair cross angle is made equal to or greater than 0.2° because larger crown changes can be made, and wider crown and strip shape control ranges can be attained even with small work-roll cross angle changes in a large pair cross angle range, for example in the range of 0.2° or greater.

Next, advantages of the present embodiment are explained.

In the hot rolling mill 1 according to the first embodiment of the present invention mentioned above, the work rolls 110A and 110B in a pair-cross state are caused to cross further relative to the backup rolls 120A and 120B, and thereby even with a micro relative cross angle between the work rolls 110A and 110B and the backup rolls 120A and 120B, for example even for the same cross angle change of 0.05°, higher controllability can be attained, and simultaneously, responsiveness can be ensured also.

In addition, because thrust forces between the work rolls 110A and 110B and the backup rolls 120A and 120B can be reduced, it becomes possible to attain advantages that small-diameter work rolls 110A and 110B can be applied, and rolling of hard steel strips becomes possible.

Furthermore, it has conventionally been required to make large work-roll cross angle changes in terms of ensuring control ranges when work-roll crossing is applied. In view of this, as a measure for reducing thrust forces, oil lubrication between rolls has been adopted.

However, in a case of the hot rolling mill 1 and hot rolling method according to the present embodiment, the cross angle between the work rolls 110A and 110B and the backup rolls 120A and 120B can be made a micro angle.

Thrust forces acting between rolls significantly influence the rolling load and roll surface conditions. For example, there is data that with water lubrication, the thrust coefficient $\mu_t$ is generally 0.2 if the cross angle θ between roll shafts is 0.2°, and the cross angle θ and the thrust coefficient $\mu_t$ generally have a proportional relation in the range of 0.2° or smaller. In a case where this relation is used, for example with a slight cross angle of 0.05°, the thrust coefficient described above is estimated as 0.2×(0.05/0.2)=0.05 [−].

Accordingly, the thrust coefficient can be reduced to a value equivalent to or smaller than the coefficient (equal to or smaller than 0.1) of thrust forces acting between the rolled material S and the work rolls 110A and 110B, thus it is possible to attain an advantage that oil lubrication becomes unnecessary even in work-roll crossing in the present embodiment.

In addition, the control apparatus 20 adjusts the pair cross angle at which the upper-side pair and the lower-side pair are caused to cross each other such that the pair cross angle is equal to or greater than 0.2 degrees, thus the advantages mentioned above can be particularly made significant by keeping the pair cross angle equal to or greater than 0.2°.

Second Embodiment

Figure 5:
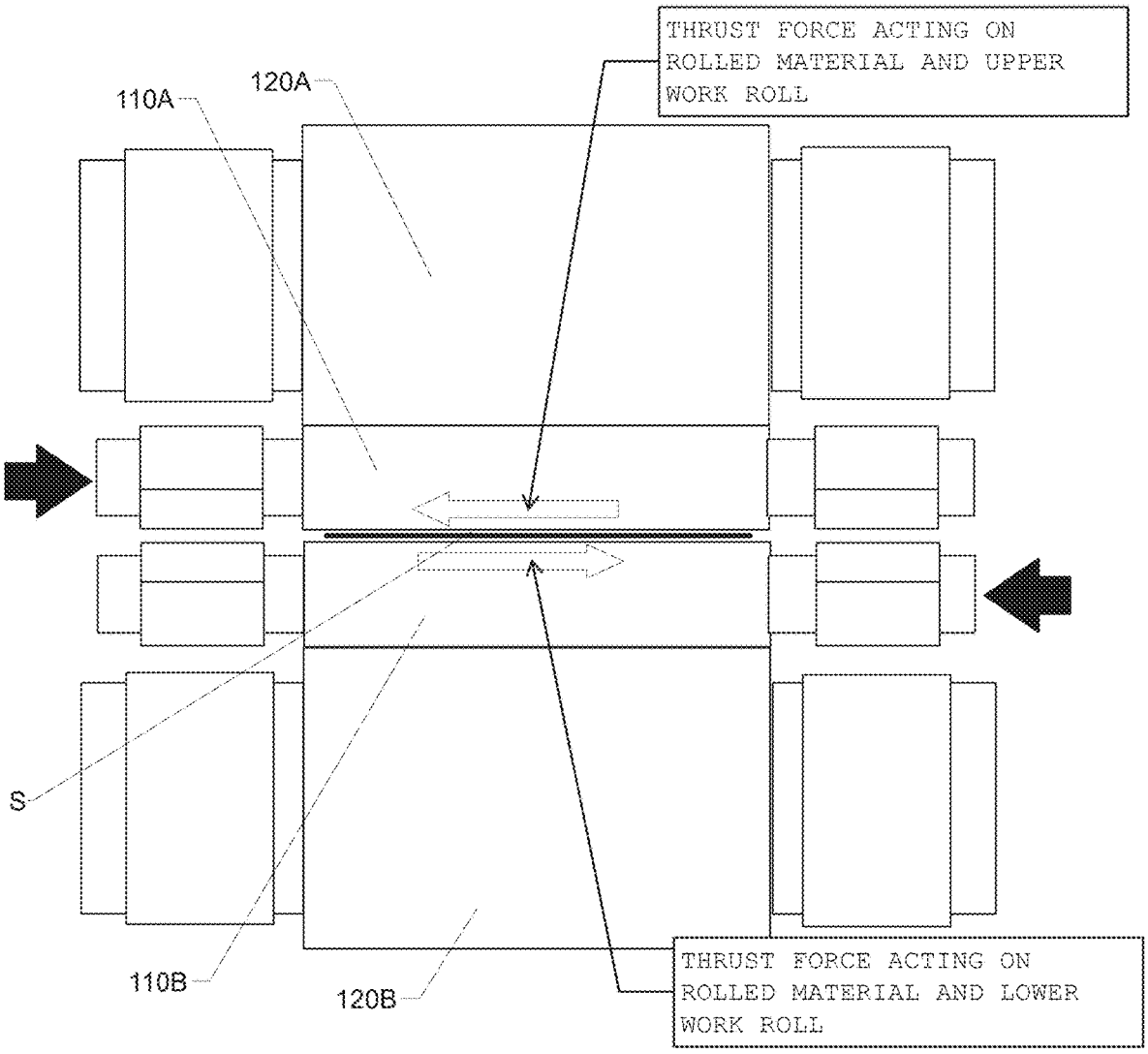
FIG. 5 is a schematic view depicting how thrust forces are generated before work-roll slight crossing in a rolling mill according to a second embodiment of the present invention.
Figure 6:
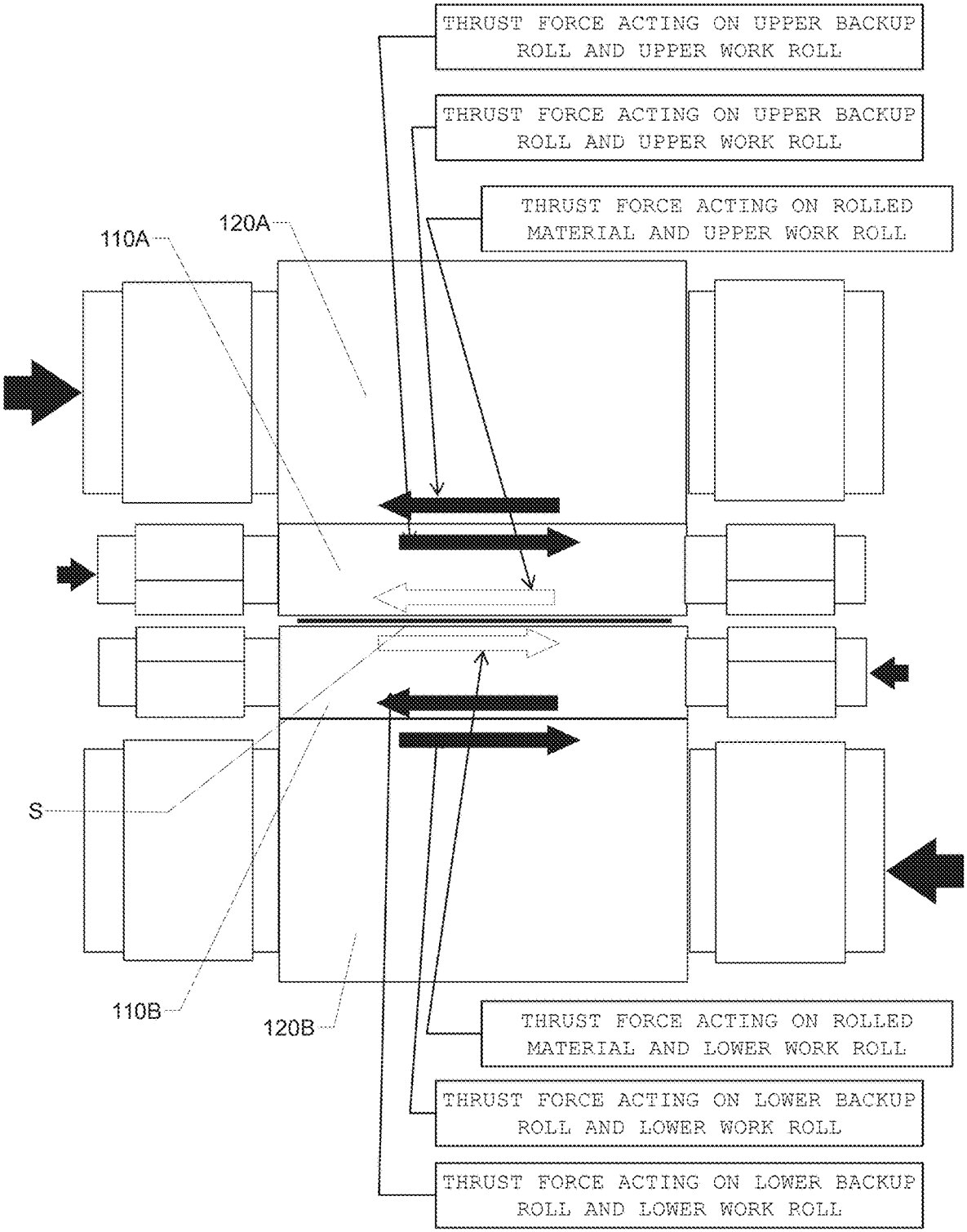
FIG. 6 is a schematic view depicting how the work-roll thrust forces are cancelled out by the work-roll slight crossing in the rolling mill according to the second embodiment.

A hot rolling mill and hot rolling method according to a second embodiment of the present invention are explained by using FIG. 5 and FIG. 6. FIG. 5 is a schematic view depicting how thrust forces are generated before work-roll slight crossing in the rolling mill according to the present second embodiment. FIG. 6 is a schematic view depicting how the work-roll thrust forces are cancelled out by the work-roll slight crossing in the rolling mill according to the present second embodiment.

First, a way of thinking about directions of action of thrust forces is explained.

The coefficient of thrust forces acting from the rolled material S on the work rolls is correlated with the cross angle and the reduction ratio of rolling, and an estimation formula like the following Formula (1) has been proposed.

$$\mu_{T,1}=F(\theta_1,r)=\mu_1\{1-\exp(-3(\theta_1^{0.9}/r^{1.1}))\} \quad (1)$$

In Formula (1), $\mu_{T,1}$ is the coefficient of thrust forces between the rolled material S and the work rolls 110A and 110B, p is the coefficient of friction, $\theta_1$ is the cross angle between the rolled material S and the work rolls 110A and 110B, and r is the reduction ratio of rolling.

In addition, taking directions of action into consideration, the coefficient of thrust forces between the work rolls 110A and 110B and the backup rolls 120A and 120B is defined by the following Formula (2).

$$\mu_{T2}=-K\theta_2 \quad (2)$$

where $\mu_{T2}$ is the coefficient of thrust forces between the backup rolls 120A and 120B and the work rolls 110A and 110B, $\theta_2$ is the cross angle between the backup rolls 120A and 120B and the work rolls 110A and 110B, and K is the influence coefficient ($\approx 1.0^{\circ -1}$).

Accordingly, if a pair cross angle $\theta_{PC}$, a slight cross angle $\theta_{WRS}$, and the rolling load are used, thrust forces acting on the work rolls 110A and 110B are represented by the relation of Formula (3) like the one mentioned below.

$$F_T=P(\mu_{T,1}+\mu_{T2})=P(F(\theta_1,r)-K\theta_2)=P(F\theta_{PC}=\theta_{WRS},r)-K\theta_{WRS}) \quad (3)$$

In Formula (3), $\theta_{WRS}$ is very small relative to $\theta_{PC}$, thus $F(\theta_{PC}+\theta_{WRS},r)$ assumes a positive value.

In view of this, in the hot rolling mill 1 and hot rolling method according to the present embodiment, in a case where work-roll crossing is performed in a state where thrust forces like the ones depicted in FIG. 5 are acting, $\theta_{WRS}$ is adjusted in such a direction that it becomes a positive value, that is, the angles of the work rolls 110A and 110B are adjusted in such directions that they become greater than the angles of the backup rolls 120A and 120B.

Thereby, as depicted in FIG. 6, it is attempted to reduce thrust forces acting on the work rolls by causing thrust forces acting from the rolled material S and thrust forces acting from the backup roll to cancel out each other.

In addition, in a case where work-roll shift is performed, it is desirable if thrust forces acting on the work rolls 110A and 110B are used.

That is, if the slight cross angle of the work rolls 110A and 110B is set such that the thrust forces act in such directions that the work rolls are shifted, the thrust forces act to support the work-roll shift, thus the capacities of shifting apparatuses can be reduced.

In other respects, the configuration/operation is approximately the same as the configuration/operation of the hot rolling mill and hot rolling method according to the first embodiment mentioned before, and details are omitted.

In the hot rolling mill and hot rolling method according to the second embodiment of the present invention also, advantages almost the same as those of the hot rolling mill and hot rolling method according to the first embodiment mentioned before are attained.

In addition, when adjusting the angles of the work rolls 110A and 110B, the control apparatus 20 adjusts the angles of the work rolls 110A and 110B in such directions that they become greater than the angles of the backup rolls 120A and 120B. Thereby, it is possible to cause thrust forces from the backup rolls 120A and 120B to act in directions opposite to thrust forces from the rolled material S acting on the work rolls 110A and 110B, and the total of the thrust forces acting on the work rolls 110A and 110B can be reduced. Accordingly, it is possible to attain advantages that the loads on the work rolls 110A and 110B in the axial direction can be reduced, it becomes easier to adopt small-diameter work rolls 110A and 110B, and bearings of the work rolls 110A and 110B are less likely to be damaged.

Third Embodiment

Figure 7:
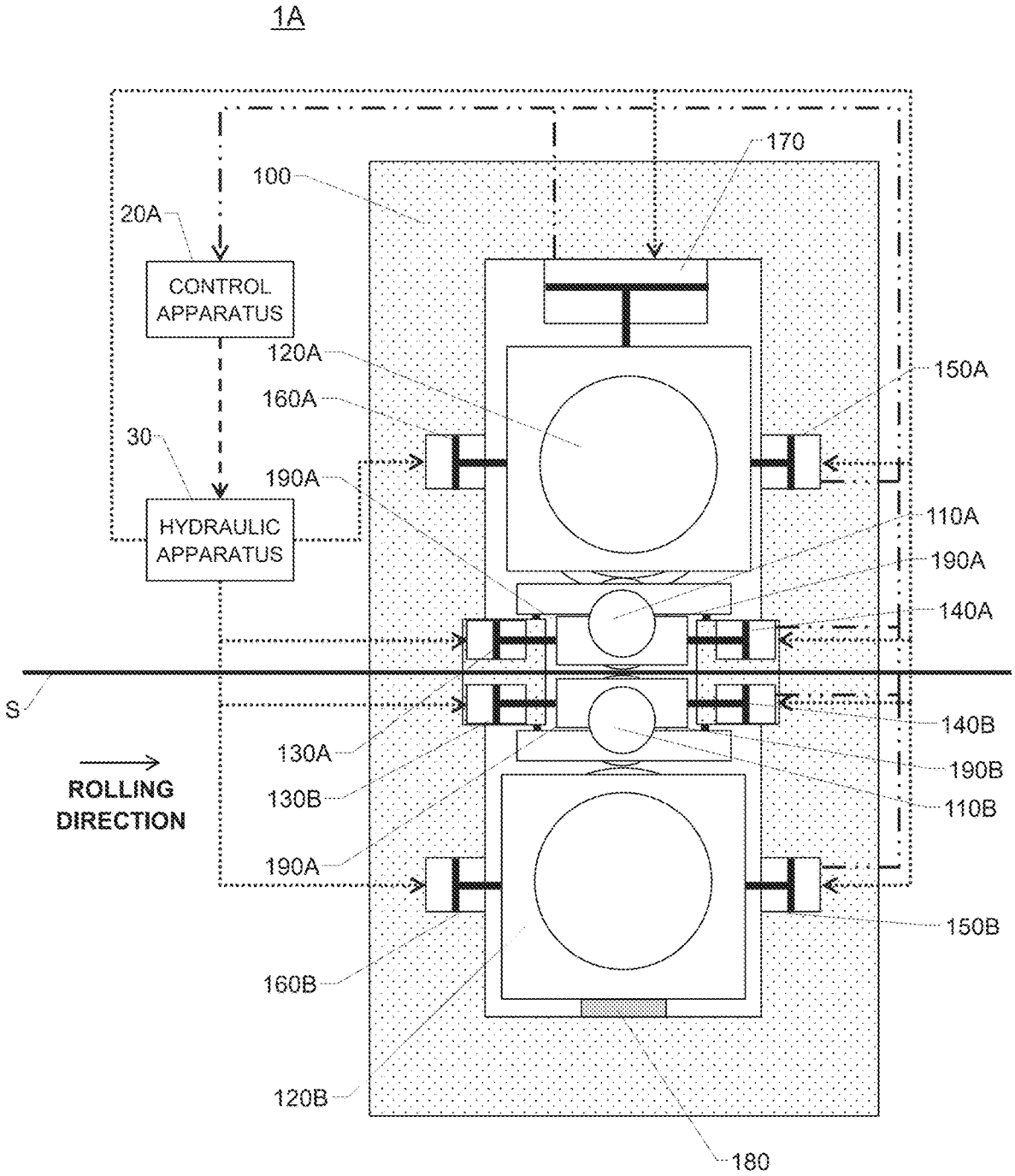
FIG. 7 is a side view depicting the apparatus configuration of a rolling mill according to a third embodiment of the present invention.

A hot rolling mill and hot rolling method according to a third embodiment of the present invention are explained by using FIG. 7. FIG. 7 is a side view depicting the apparatus configuration of a rolling mill according to the present third embodiment.

A hot rolling mill 1A according to the present embodiment depicted in FIG. 7 is the same as the hot rolling mill 1 according to the first embodiment, except that it does not include the backup-roll sliding apparatuses 200A and 200B.

In addition, a control apparatus 20A of the hot rolling mill 1A according to the present embodiment executes adjustment of a pair cross angle at which the upper-side pair and the lower-side pair cross each other before rolling of the rolled material S is started. Furthermore, adjustment of the angles of the work rolls 110A and 110B is executed during the rolling of the rolled material S.

In other respects, the configuration/operation is approximately the same as the configuration/operation of the hot rolling mill and hot rolling method according to the first embodiment mentioned before, and details are omitted.

In the hot rolling mill and hot rolling method according to the third embodiment of the present invention also, advantages almost the same as those of the hot rolling mill and hot rolling method according to the first embodiment mentioned before are attained.

As mentioned above, the roll chocks of the backup rolls 120A and 120B are supported by the housing 100 through the pressing apparatuses 150A and 150B, the home-position control apparatuses 160A and 160B, and the load cell 180.

If the cross angle of the backup rolls 120A and 120B during rolling is changed in such a state, large sliding resistances are generated between fixation members due to the rolling load, thus actuators to change the cross angle need to have large capacities, and also members such as bearings for making sliding sections movable are required.

The movable members have low rigidity, and become a factor to lower the rigidity of the rolling mill itself. In that case, this becomes a factor of disturbance of the shape of the rolled material S, also causes strip movement of the rolled material S along lateral direction and lowers the stability of strip threading.

In contrast, by executing the angle adjustment in a pair-cross state before rolling of the rolled material S is started, the change can be made at a time of a low load. Accordingly, it is possible to reduce the capacities of the actuators to change the cross angle of the backup rolls 120A and 120B, and also it becomes unnecessary to provide mechanisms such as bearings to make the backup rolls 120A and 120B smoothly movable on sliding surfaces of support members. Accordingly, it is possible to attain advantages that it is possible to reduce equipment costs by making the equipment a simple and convenient one with low capacities, and also it becomes possible to avoid reduction of the rigidity of the rolling mill and to more stabilize rolling.

Furthermore, by executing the angle adjustment of the work rolls 110A and 110B during the rolling of the rolled material S, the control apparatus 20A can ensure responsiveness while surely attaining wide control ranges.

Fourth Embodiment

Figure 8:
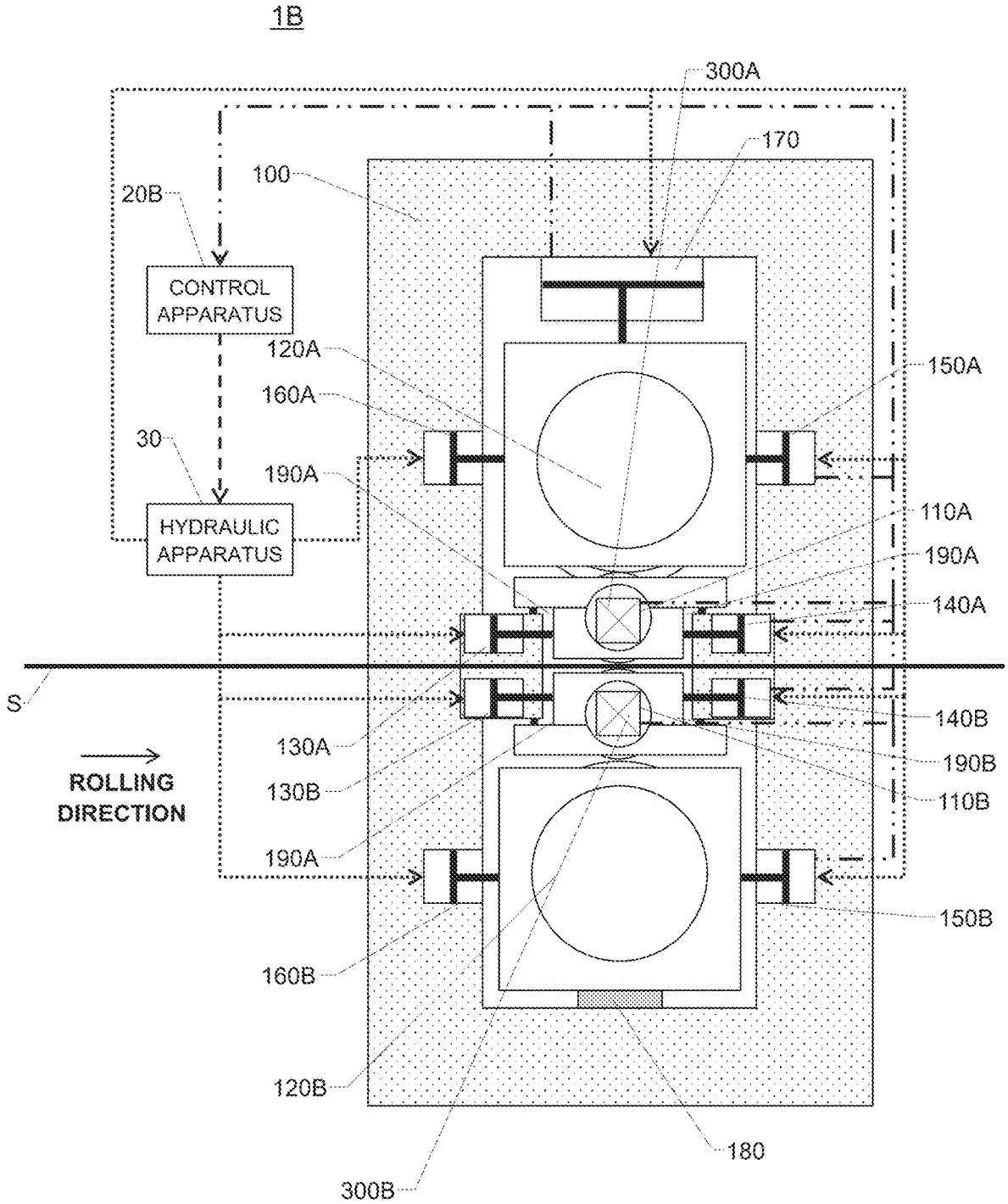
FIG. 8 is a side view depicting the apparatus configuration of a rolling mill according to a fourth embodiment of the present invention.

A hot rolling mill and hot rolling method according to a fourth embodiment of the present invention are explained by using FIG. 8. FIG. 8 is a side view depicting the apparatus configuration of a rolling mill according to the present fourth embodiment.

A hot rolling mill 1B according to the present embodiment depicted in FIG. 8 is the same as the hot rolling mill 1 according to the first embodiment, except that it does not include the backup-roll sliding apparatuses 200A and 200B, and is further provided with thrust force measuring apparatuses 300A and 300B that measure thrust forces acting on the shafts of the work rolls 110A and 110B.

In addition, a control apparatus 20B of the hot rolling mill 1B according to the present embodiment controls the work-roll pressing apparatuses 130A and 130B and the work-roll position control apparatuses 140A and 140B such that the angles of the work rolls 110A and 110B relative to the backup rolls 120A and 120B are changed when the thrust forces measured by the thrust force measuring apparatuses 300A and 300B become greater than a predetermined upper limit value. For example, in a case where the direction of thrust forces acting between the rolled material S and the work rolls 110A and 110B is a positive direction and the thrust forces become greater than the upper limit value, the cross angle of the work rolls 110A and 110B is controlled so as to be increased.

Furthermore, the work-roll pressing apparatuses 130A and 130B and the work-roll position control apparatuses 140A and 140B are controlled such that the angles of the work rolls 110A and 110B relative to the backup rolls 120A and 120B are changed when the thrust forces measured by the thrust force measuring apparatuses 300A and 300B become smaller than a predetermined lower limit value. For example, in a case where the thrust forces become smaller than the lower limit value, the cross angle of the work rolls 110A and 110B is controlled so as to be decreased.

In other respects, the configuration/operation is approximately the same as the configuration/operation of the hot rolling mill and hot rolling method according to the first embodiment mentioned before, and details are omitted.

In the hot rolling mill and hot rolling method according to the fourth embodiment of the present invention also, advantages almost the same as those of the hot rolling mill and hot rolling method according to the first embodiment mentioned before are attained.

In addition, the higher the hardness of a rolling-subject steel strip is, the larger the thrust forces on the work rolls are. In view of this, by controlling the work-roll pressing apparatuses 130A and 130B and the work-roll position control apparatuses 140A and 140B such that the angles of the work rolls 110A and 110B relative to the backup rolls 120A and 120B are changed when the thrust forces measured by the thrust force measuring apparatuses 300A and 300B are greater than the predetermined upper limit value, the control apparatus 20B can perform control such that thrust forces on the work rolls 110A and 110B do not exceed thrust forces that the work rolls 110A and 110B can endure, and can prevent damage of members.

Furthermore, the control apparatus 20B can eliminate backlashes between the work rolls 110A and 110B and members supporting them by controlling the work-roll pressing apparatuses 130A and 130B and the work-roll position control apparatuses 140A and 140B such that the angles of the work rolls 110A and 110B relative to the backup rolls 120A and 120B are changed when the thrust forces measured by the thrust force measuring apparatuses 300A and 300B become smaller than the predetermined lower limit value, and can stabilize the positions of the work rolls in the strip-width direction.

Fifth Embodiment

A hot rolling mill and hot rolling method according to a fifth embodiment of the present invention are explained by using FIG. 9 to FIG. 18.

Figure 9:
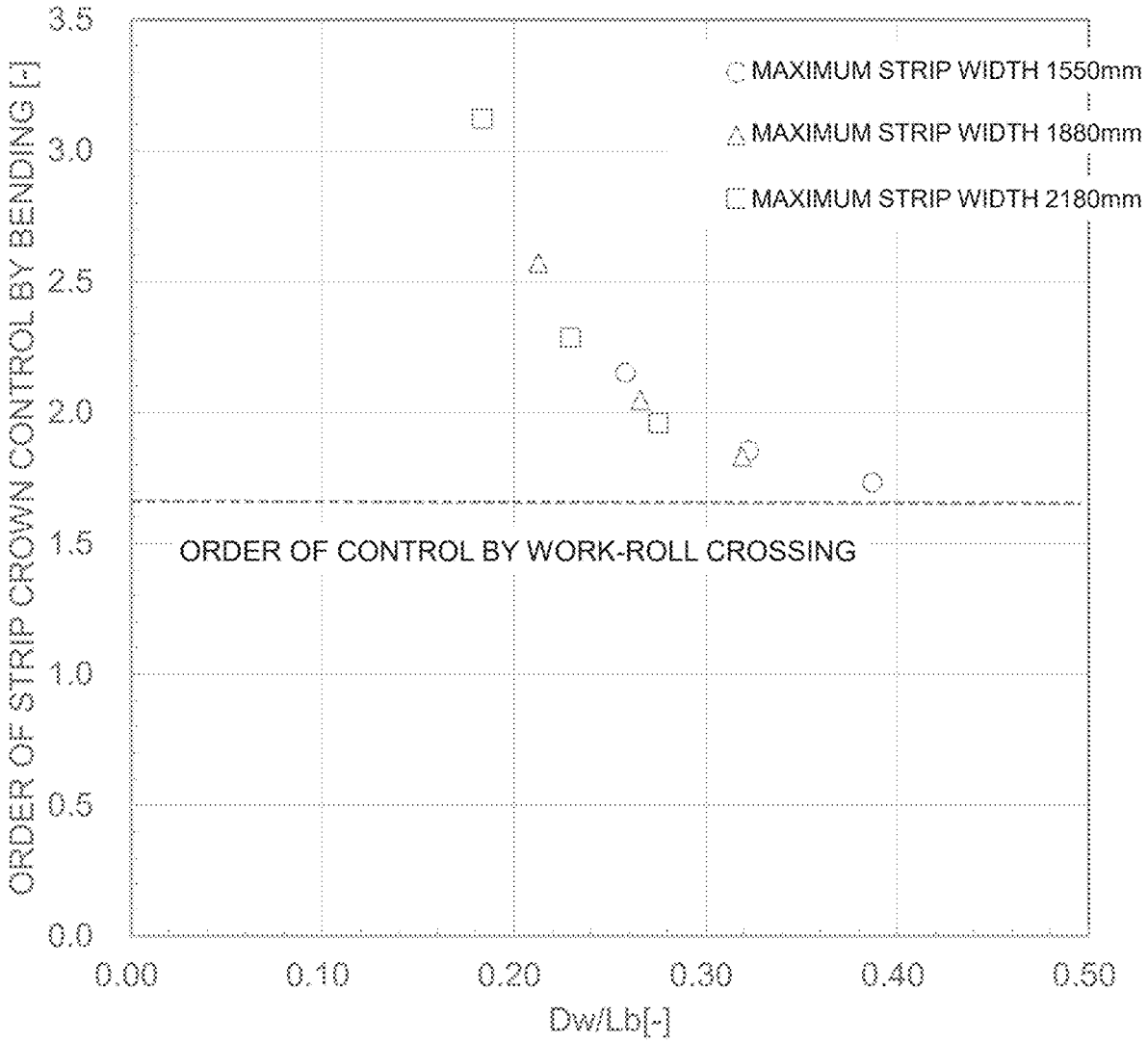
FIG. 9 is a figure depicting how a work-roll diameter influences the order of control by bending in a rolling mill according to a fifth embodiment of the present invention.
Figure 10:
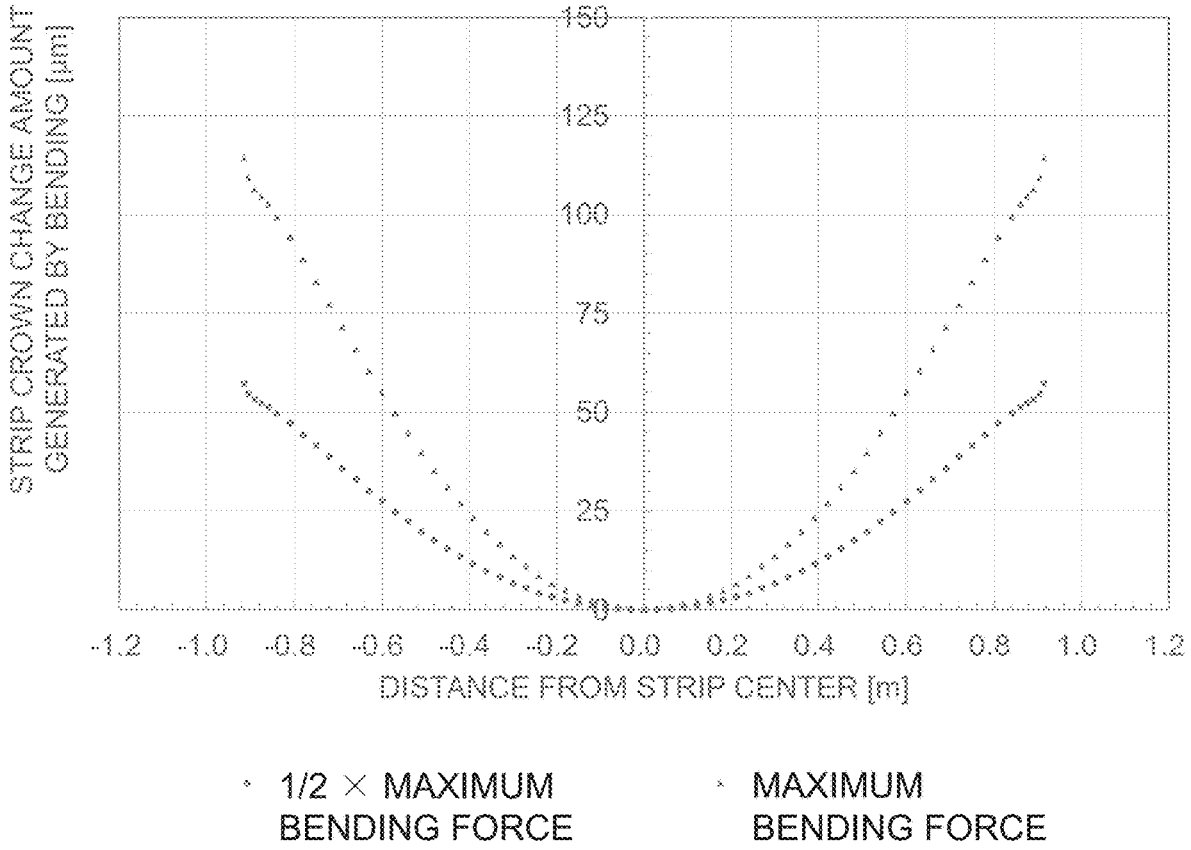
FIG. 10 is a figure depicting a distribution, in the strip-width direction, of strip crown change amounts in a case where bending is performed in a rolling mill with $D_w/L_b$=0.32.
Figure 11:
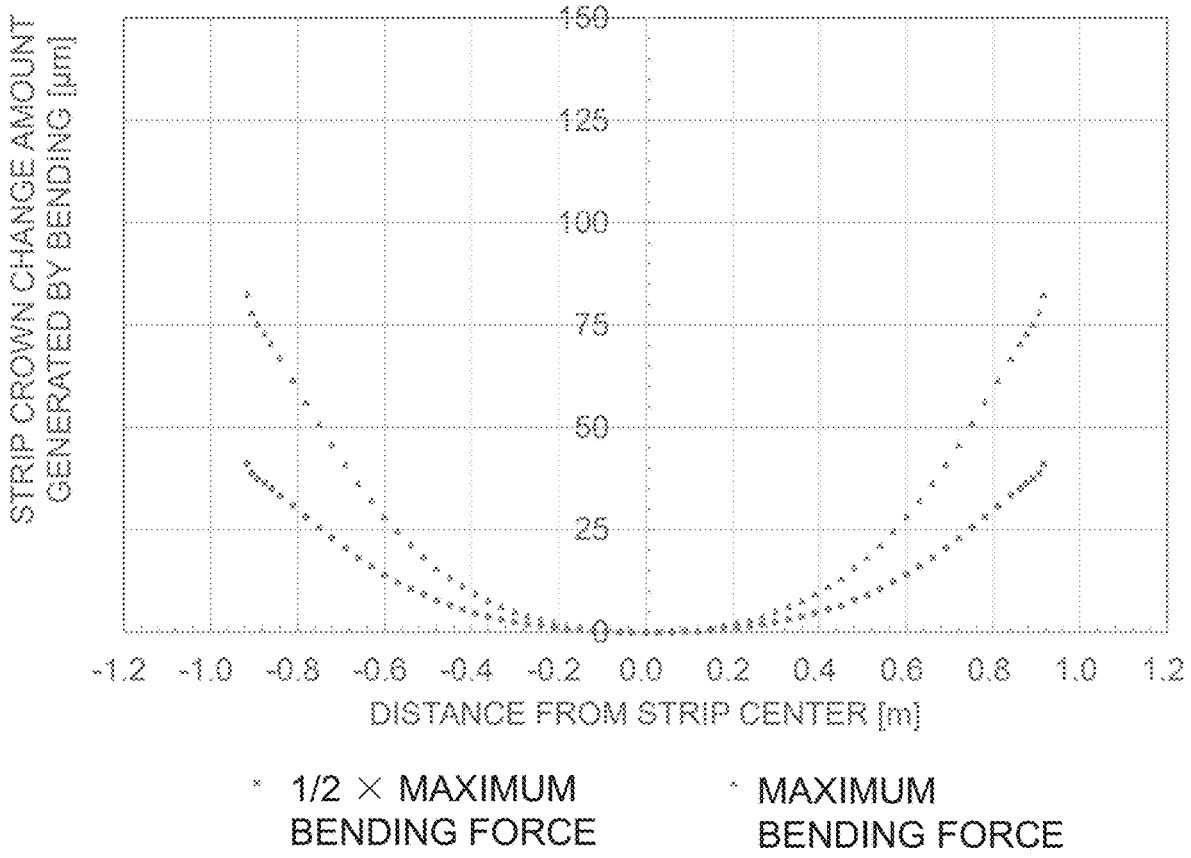
FIG. 11 is a figure depicting a distribution, in the strip-width direction, of strip crown change amounts in a case where bending is performed in a rolling mill with $D_w/L_b$=0.21.
Figure 12:
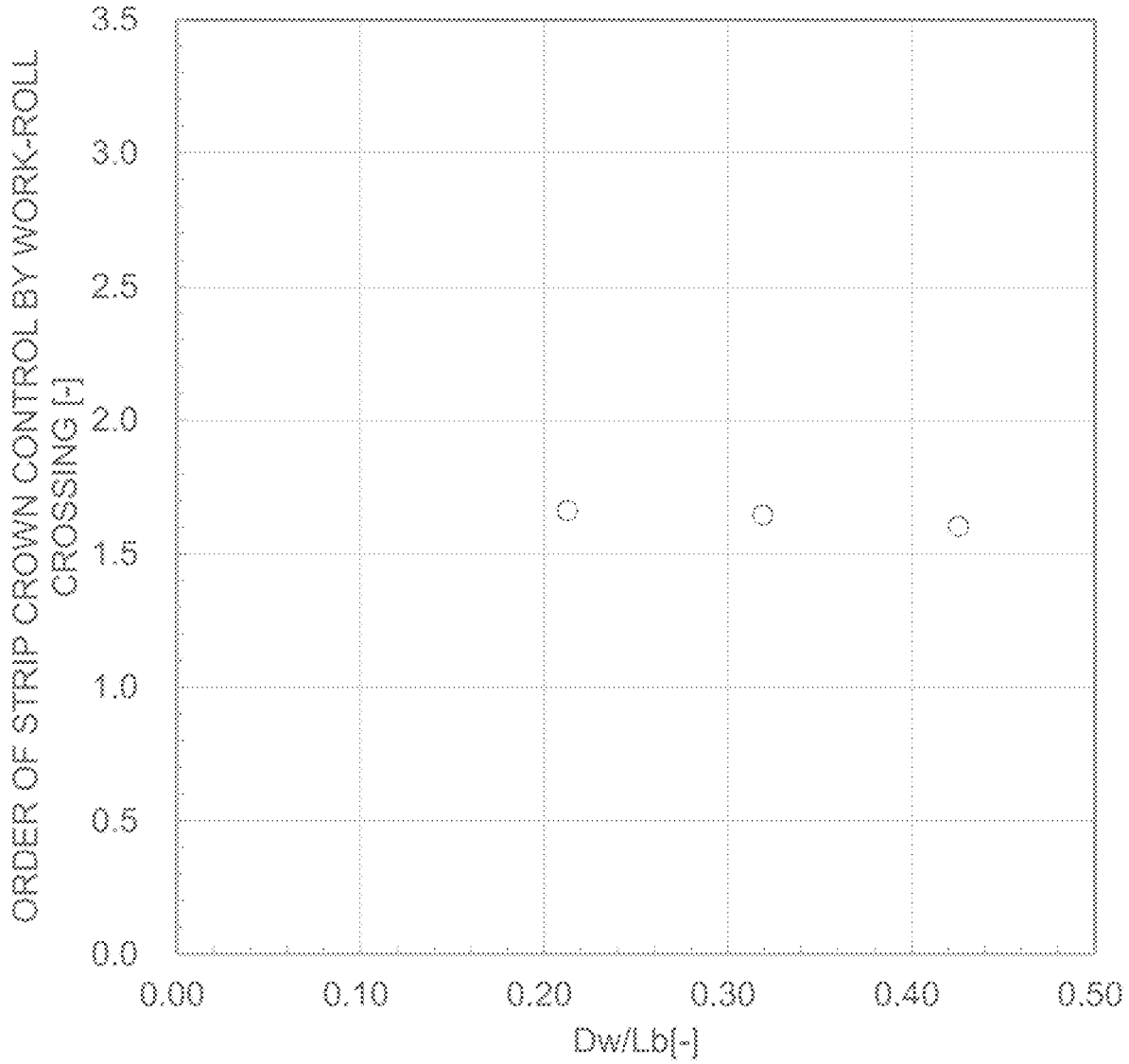
FIG. 12 is a figure depicting how a work-roll diameter influences the order of control by work-roll crossing in the rolling mill according to the fifth embodiment.
Figure 13:
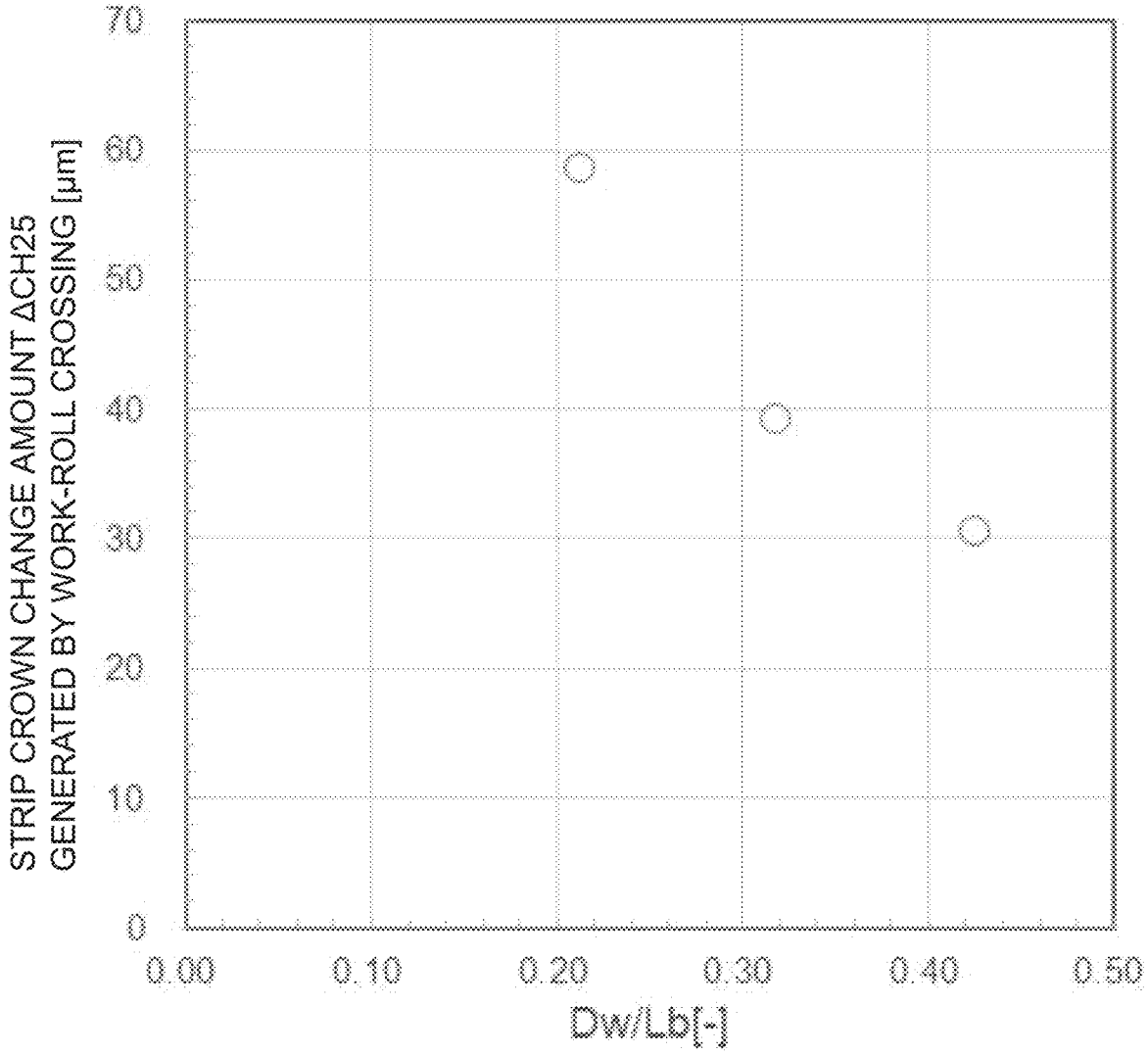
FIG. 13 is a figure depicting how a work-roll diameter influences strip crown change amounts generated by work-roll crossing.
Figure 14:
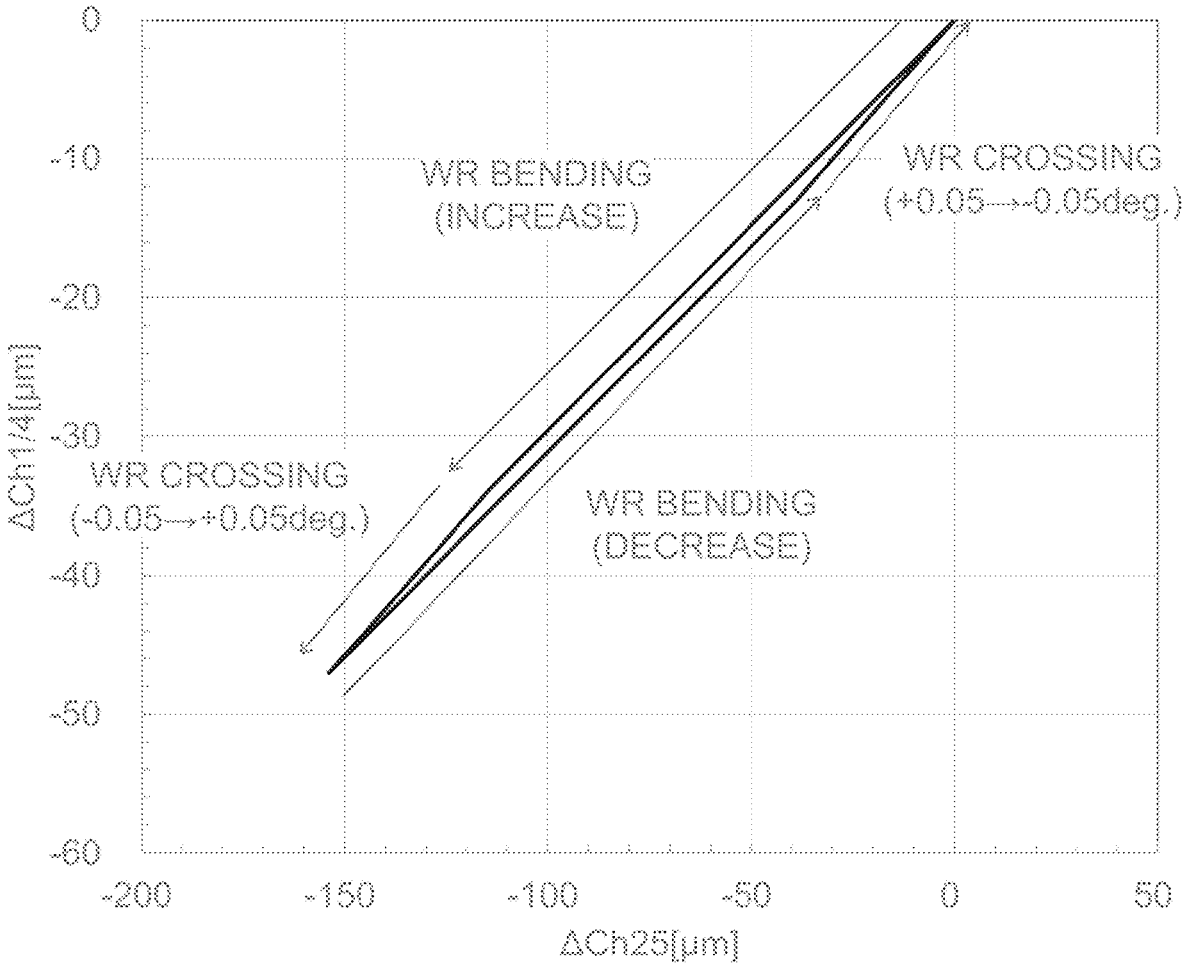
FIG. 14 is a figure depicting crown control ranges in a rolling mill with $D_w/L_b$=0.32.
Figure 15:
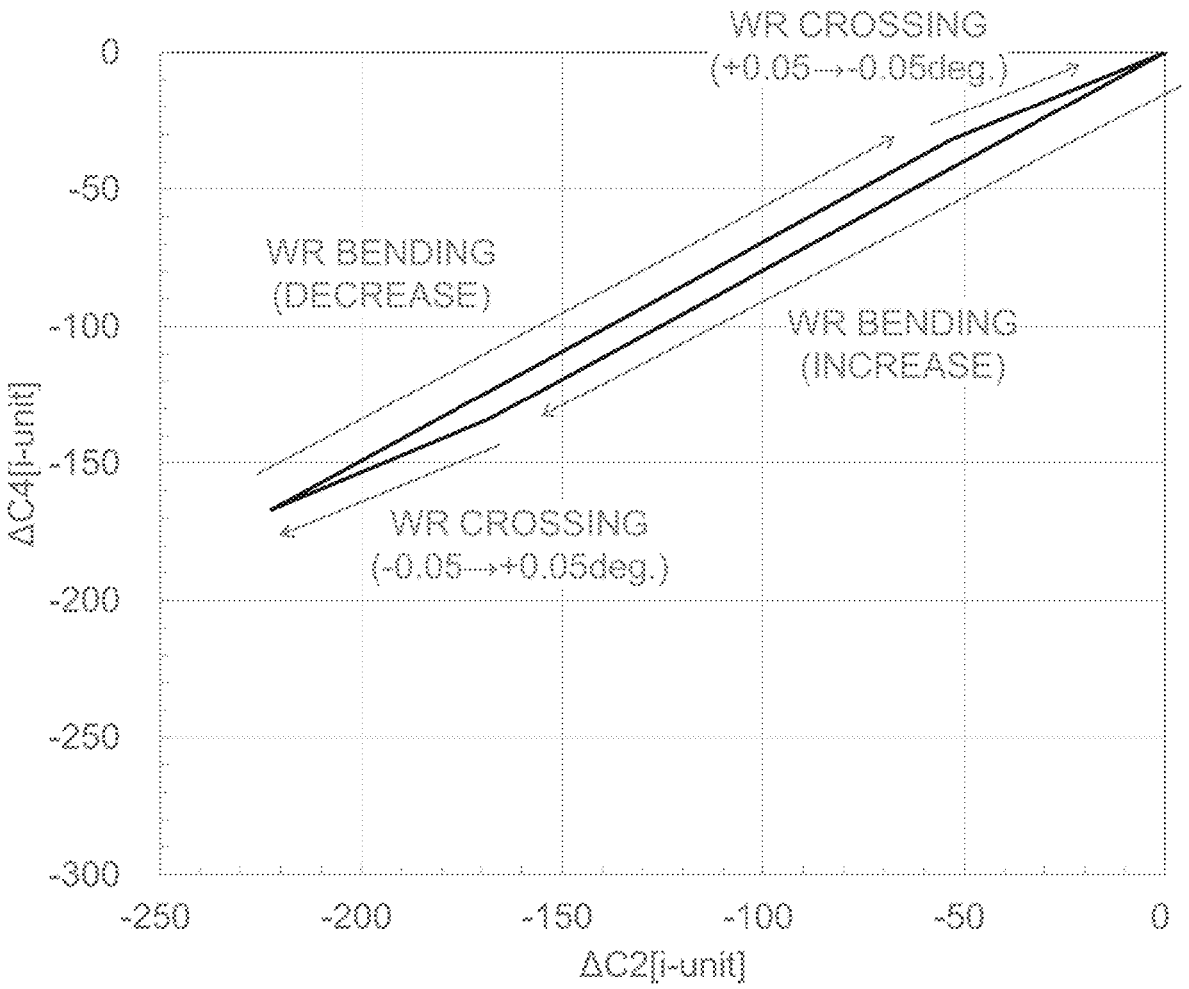
FIG. 15 is a figure depicting shape control ranges in the rolling mill with $D_w/L_b$=0.32.
Figure 16:
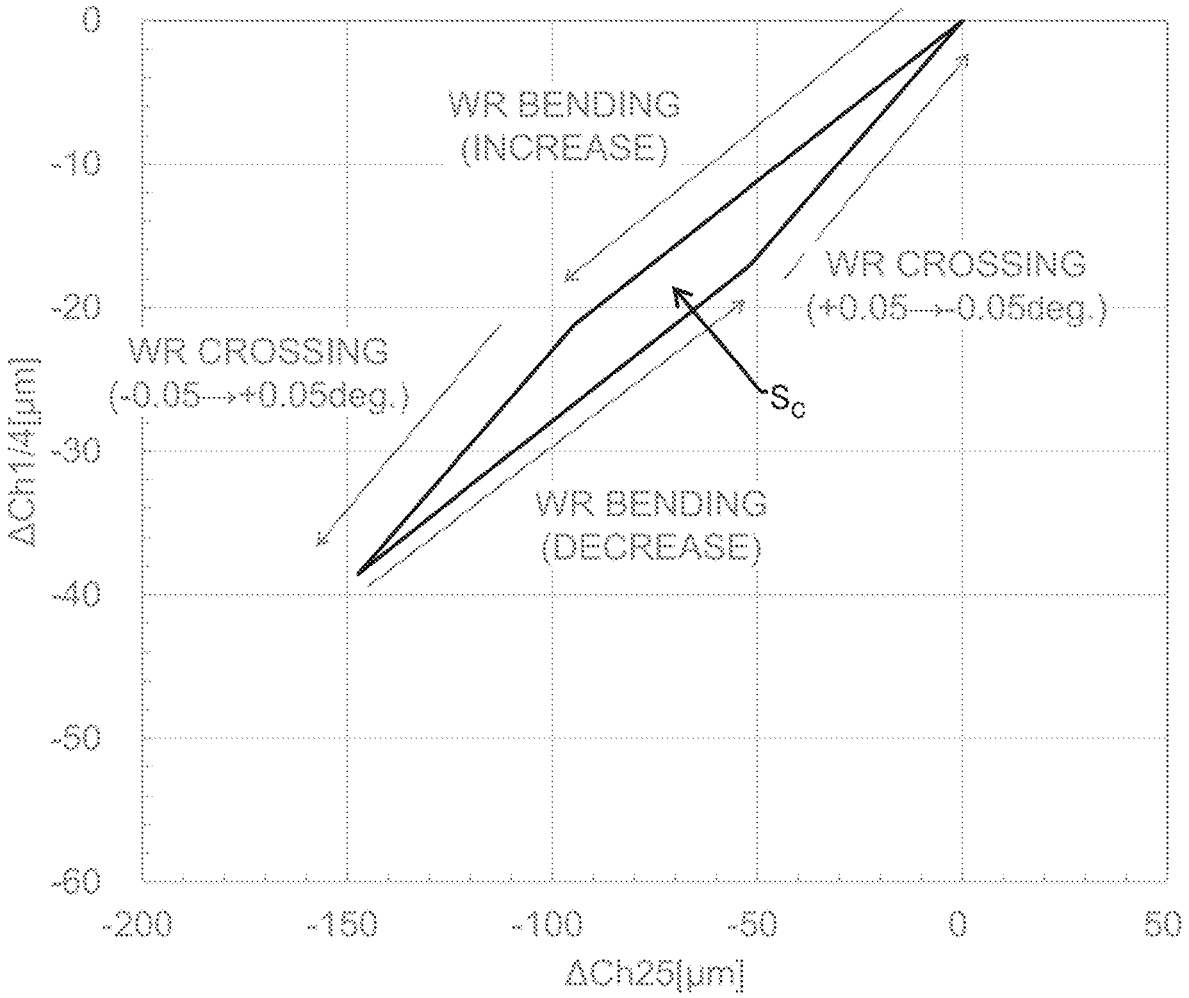
FIG. 16 is a figure depicting crown control ranges in a rolling mill with $D_w/L_b$=0.24.
Figure 17:
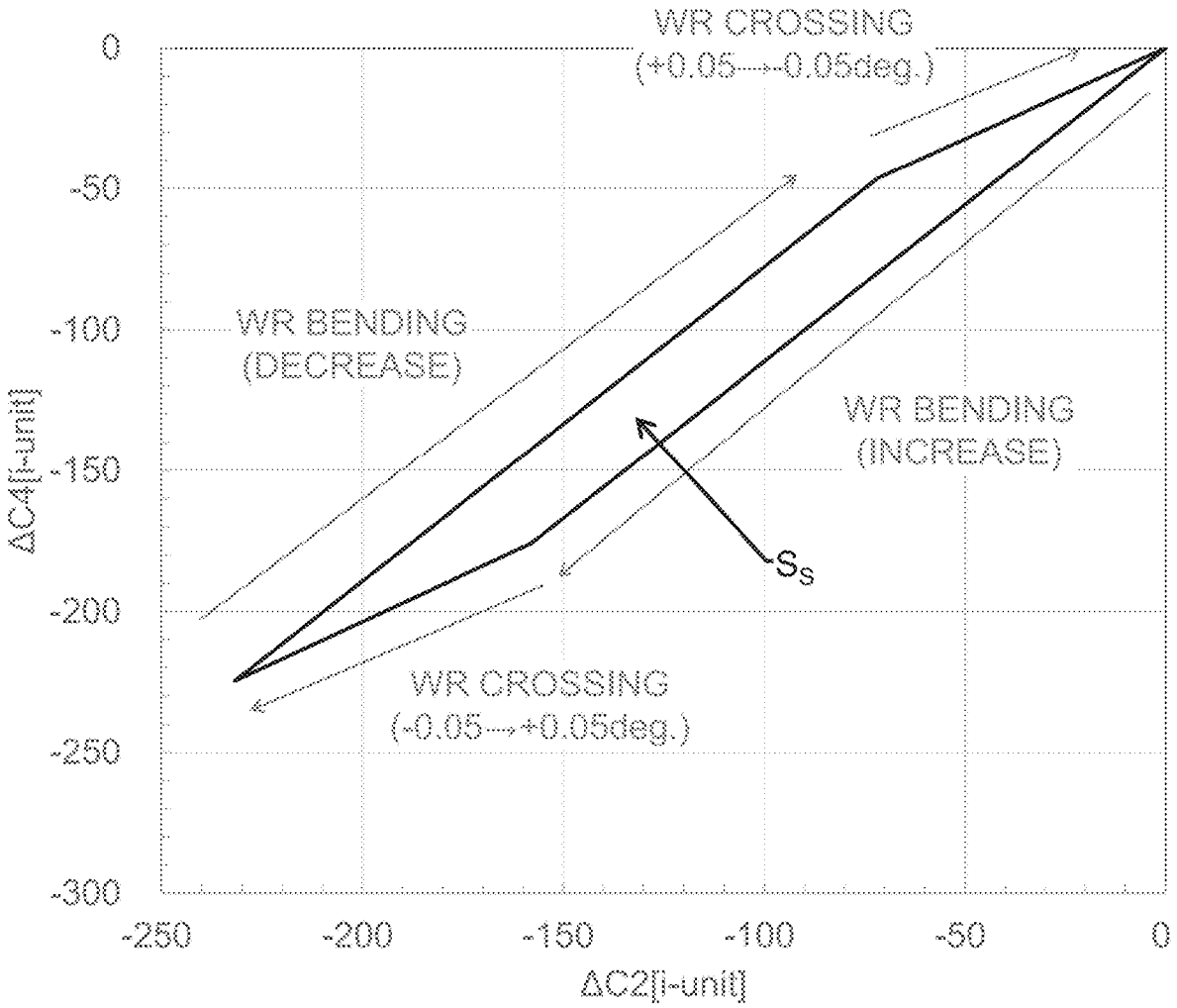
FIG. 17 is a figure depicting shape control ranges in the rolling mill with $D_w/L_b$=0.24.
Figure 18:
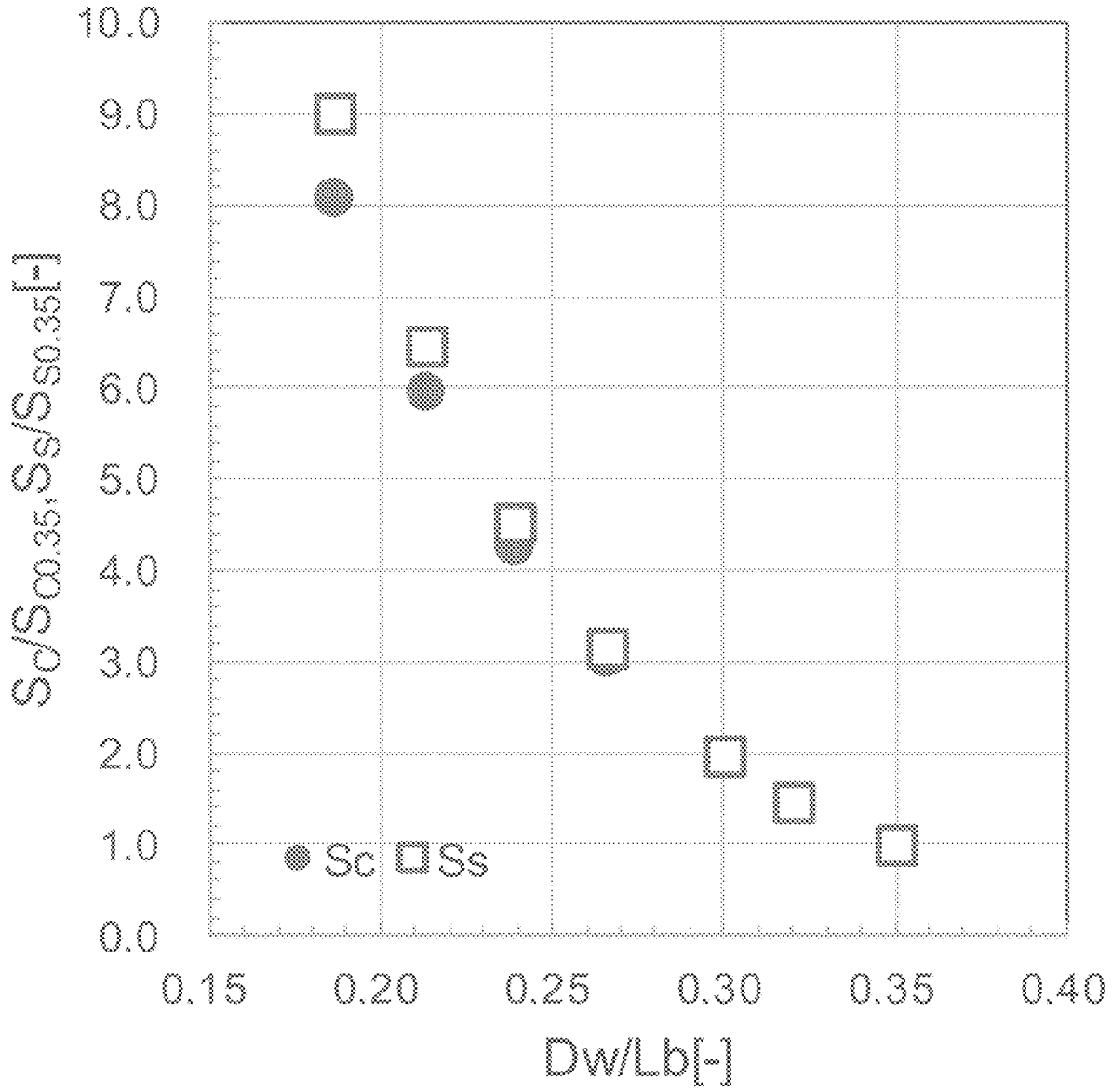
FIG. 18 is a figure depicting influence of $D_w/L_b$ on crown control and shape control ranges in the rolling mill according to the fifth embodiment.

FIG. 9 is a figure depicting how a work-roll diameter influences the order of control by bending. FIG. 10 is a figure depicting a distribution, in the strip-width direction, of strip crown change amounts in a case where bending is performed in a rolling mill with $D_w/L_b$=0.32. FIG. 11 is a figure depicting a distribution, in the strip-width direction, of strip crown change amounts in a case where bending is performed in a rolling mill with $D_w/L_b$=0.21. FIG. 12 is a figure depicting how a work-roll diameter influences the order of control by work-roll crossing. FIG. 13 is a figure depicting how a work-roll diameter influences strip crown change amounts generated by work-roll crossing. FIG. 14 is a figure depicting crown control ranges in the rolling mill with $D_w/L_b$=0.32. FIG. 15 is a figure depicting shape control ranges in the rolling mill with $D_w/L_b$=0.32. FIG. 16 is a figure depicting crown control ranges in a rolling mill with $D_w/L_b$=0.24. FIG. 17 is a figure depicting shape control ranges in the rolling mill with $D_w/L_b$=0.24. FIG. 18 is a figure depicting influence of $D_w/L_b$ on crown control and shape control ranges.

The hot rolling mill according to the present embodiment is the same as the hot rolling mill 1 according to the first embodiment in terms of basic apparatus configuration.

As a further limitation, in the hot rolling mill according to the present embodiment, the work rolls 110A and 110B satisfy the condition that $D_w/L_b$ is equal to or greater than 0.15 and equal to or smaller than 0.3 where $D_w$ is the diameter of the work rolls 110A and 110B, and $L_b$ is the maximum strip width of the rolled material S.

The ratio $D_w/L_b$ between a work-roll diameter $D_w$ and a maximum strip width $L_b$ is within the range of 0.32 to 0.40 in typical pair cross mills, and, in this range, it is possible to perform second-order shape control by work roll bending, but it is difficult to perform higher-order shape control. In addition, principles similar to those of pair cross mills are applied to work-roll cross mills, and generally the same tendency is observed.

FIG. 9 and the figures that follow are figures depicting simulation results of change amounts of the strip crown and strip shape under the condition that a rolled material with hardness of 20 kgf/mm$^2$ is 20% rolling reduction ratio into a 2-mm strip. Here, not the strip shape control order but the strip crown control order is depicted because the strip crown and the strip shape generally correspond to each other. As depicted in FIG. 9, it can be known that the order of strip crown control by bending tends to increase as $D_w/L_b$ decreases.

FIG. 10 depicts a distribution of strip crown change amounts that are observed when increase bending is applied in a case where $D_w/L_b$ is 0.32 ($D_w$: 600 m, $L_b$: 1880 mm), and FIG. 11 depicts a distribution of strip crown change amounts that are observed when increase bending is applied in a case where $D_w/L_b$ is 0.21 ($D_w$: 400 m, $L_b$: 1880 mm).

As depicted in FIG. 10 and FIG. 11, it can be known that the crown change amounts near the strip center are small, and there is significant influence on strip ends in a case of a high control order (control order 2.6), that is, in a case where $D_w/L_b$ is 0.21.

In addition, as depicted in FIG. 12, it can be known that the control exponent of work-roll crossing is approximately 1.65, thus by making $D_w/L_b$ at least equal to or smaller than 0.3, the difference between the control orders of work-roll crossing and bending can be increased, and it is expected that a complicated shape like quarter buckle can be controlled.

In addition, the crown control order is approximately 1.65, and influence of $D_w/L_b$ is extremely small. Although it is considered that this order is slightly influenced by rolling conditions due to roll flattening, roll deflection, or the like, the control order is generally 2.0 irrespective of a work-roll diameter.

FIG. 13 depicts results of simulations of a changed roll diameter about crown change amounts ΔCh25 when work rolls are caused to cross at −0.05° to 0.05° relative to backup rolls from a state of a pair cross angle 0.5° where crown Ch25 is the difference of the strip thickness between the strip center and a 25-mm position from a strip end. As depicted in FIG. 13, it can be known that a geometrically-generated gap increases as the diameter is reduced, thus controllable ranges also widen naturally.

FIG. 14 to FIG. 17 depict results of estimation by simulations of the strip crown control range and the second-order and fourth-order strip shape control ranges.

FIG. 14 and FIG. 15 depict results that are obtained under the condition of: pair cross (0.50°), $D_w$=602 mm and $D_w/L_b$=0.32, and FIG. 16 and FIG. 17 depict results that are obtained under the condition of: pair cross (0.50°), $D_w$=450 mm and $D_w/L_b$=0.24.

Then, FIG. 14 and FIG. 16 depict relations of strip crown change amounts ΔCh1/4 at a widthwise ¼-position (quarter position) to strip crown change amounts ΔCh25 of a 25-mm position from an end, and FIG. 15 and FIG. 17 depict relations of fourth-order component change amounts ΔC4 to second-order component change amounts ΔC2 of the deviation of longitudinal strain.

It can be known that, under the conventional range condition of DW/Lb=0.32 depicted in FIG. 14 and FIG. 15, the value of ΔCh1/4 relative to ΔCh25, and the value of ΔC4 relative to ΔC2 change at generally equal gradients in both a case where the cross angle of work-roll crossing is changed, and a case where work-roll bending is increased and reduced, and the ranges within which ΔCh25 and ΔCh1/4 and ΔC2 and ΔC4 can be controlled individually are very narrow.

In contrast, as depicted in FIG. 16 and FIG. 17, in a case where a condition of the present invention, $D_w/L_b$=0.24, is adopted, the value of ΔCh1/4 relative to ΔCh25, and the value of ΔC4 relative to ΔC2 change at different gradients in a case where the cross angle of work-roll crossing is changed, and a case where the work-roll bending is increased and reduced. Accordingly, it can be known that the locus that is formed by following an increase in work-roll bending, a change in the work-roll cross angle from 0.45° to 0.55°, a reduction of work-roll bending and a change in the work-roll cross angle from 0.55° to 0.45° in this order gives a parallelogram shape, and the ranges within which ΔCh25 and ΔCh1/4, and ΔC2 and ΔC4 can be controlled individually widen significantly.

Here, as indicators of the ranges within which ΔCh25 and ΔCh1/4, and ΔC2 and ΔC4 can be controlled individually, respectively, the area size in the parallelogram in the graph of ΔCh25 and ΔCh1/4 is defined as $S_c$, and the area size in the parallelogram in the graph of ΔC2 and ΔC4 is defined as $S_s$. Taking this into consideration, FIG. 18 depicts results of plotting ratios relative to area sizes $S_{c0.35}$ and $S_{s0.35}$ when $D_w/L_b$ is 0.35 in relation to $D_w/L_b$.

As depicted in FIG. 18, it has become clear that, by adopting the condition that $D_w/L_b$=0.28 or smaller, as compared with $D_w/L_b$=0.32 under which the work-roll diameter is categorized as a small diameter even in the current situation, a center/edge buckle which is approximately twice or more than twice as long can be realized, and the shape controllability is enhanced significantly.

Here, in hot rolling processes, typically, work rolls are connected to motors and rotation-driven. In that case, if the diameter of the work rolls is reduced, the spindle diameter is reduced, thus transmittable torque also decreases.

Whereas reduction of the diameter of the work rolls reduces rolling torque also, the influence of the reduction of the diameter of the work rolls is more significant on the limitation of torque transmission of spindles. That is, if the diameter of the work rolls is too small, difficulties in terms of mechanical feasibility arise, and it is considered that disadvantages outweigh advantages.

The rolling torque depends on rolling conditions, and it is determined that it is possible to make feasible modes in which advantages outweigh disadvantages by making $D_w/L_b$ at least equal to or greater than 0.15 in typical hot rolling plants; therefore, it is desirable if the lower limit of $D_w/L_b$ is set to 0.15 or greater.

Summarizing what have been described thus far, it is desirable if a suitable range of $D_w/L_b$ is 0.15 or greater and 0.30 or smaller, and more suitably 0.15 or greater and 0.28 or smaller.

In other respects, the configuration/operation is approximately the same as the configuration/operation of the hot rolling mill and hot rolling method according to the first embodiment mentioned before, and details are omitted.

In the hot rolling mill and hot rolling method according to the fifth embodiment of the present invention also, advantages almost the same as those of the hot rolling mill and hot rolling method according to the first embodiment mentioned before are attained.

In addition, the work-roll bending cylinders 190A and 190B that apply bending forces to the work rolls 110A and 110B are further provided, the work rolls 110A and 110B satisfy the condition that $D_w/L_b$ is equal to or greater than 0.15 and equal to or smaller than 0.3 where $D_w$ is the diameter of the work rolls 110A and 110B, and $L_b$ is the maximum strip width of the rolled material S. Thereby, both bending force control and cross angle control are performed, harder steel strips than ones that conventional technologies can cope with can be rolled with a work-roll diameter equal to or smaller than that in the conventional technologies, and also more complicated shape control becomes possible.

Others

Note that the present invention is not limited to the embodiments described above, and includes various modification examples. The embodiments described above are explained in detail in order to explain the present invention in an easy-to-understand manner, and the present invention is not necessarily limited to those including all the configurations explained.

In addition, it is also possible to replace some of the configurations of an embodiment with configurations of another embodiment, and it is also possible to add a configuration of an embodiment to the configurations of another embodiment. In addition, some of the configurations of each embodiment can also have other configurations, be deleted or be replaced with other configurations.

DESCRIPTION OF REFERENCE CHARACTERS

S: Rolled material
1, 1A, 1B: Hot rolling mill
20, 20A, 20B: Control apparatus
30: Hydraulic apparatus
100: Housing
110A: Upper work roll
110B: Lower work roll
112A: Work-side roll chock
112B: Drive-side roll chock
120A: Upper backup roll
120B: Lower backup roll
130A, 130B: Work-roll pressing apparatus
140A, 140B: Work-roll position control apparatus
150A, 150B: Backup-roll pressing apparatus
160A, 160B: Backup-roll position control apparatus
170: Hydraulic cylinder apparatus
180: Load cell
190A: Upper work-roll bending cylinder
190B: Lower work-roll bending cylinder
200A, 200B: Backup-roll sliding apparatus
300A, 300B: Thrust force measuring apparatus

The invention claimed is:

1. A hot rolling mill comprising:
a pair of upper and lower work rolls;
a pair of upper and lower backup rolls that support the work rolls, respectively;
work-roll horizontal actuators that move the work rolls in a horizontal direction;
backup-roll horizontal actuators that move the backup rolls in the horizontal direction; and
a control apparatus that controls angle adjustment by the work-roll horizontal actuators, and angle adjustment by the backup-roll horizontal actuators, wherein
the control apparatus
adjusts angles of an upper-side pair of the upper work roll and the upper backup roll, and a lower-side pair of the lower work roll and the lower backup roll in a state where the upper-side pair is kept parallel and in a state where the lower-side pair is kept parallel to obtain a pair cross angle at which the upper-side pair and the lower-side pair cross each other such that the pair cross angle becomes equal to or greater than 0.2 degrees; and thereafter
controls the work-roll horizontal actuators and the backup-roll horizontal actuators such that the angles of the upper work roll and the lower work roll are adjusted in a state where the angles of the upper backup roll and the lower backup roll are maintained.

2. The hot rolling mill according to claim 1, wherein
the control apparatus adjusts the angles of the work rolls in such directions that the angles of the work rolls become greater than the angles of the backup rolls, when the control apparatus adjusts the angles of the work rolls.

3. The hot rolling mill according to claim 1, wherein the control apparatus executes adjustment of a pair cross angle at which the upper-side pair and the lower-side pair cross each other before rolling of a rolled material is started.

4. The hot rolling mill according to claim 3, wherein the control apparatus executes adjustment of the angles of the work rolls during the rolling of the rolled material.

5. The hot rolling mill according to claim 1, further comprising:

thrust force measuring apparatuses that measure thrust forces acting on shafts of the work rolls, wherein the control apparatus controls the work-roll horizontal actuators such that the angles of the work rolls relative to the backup rolls are changed when the thrust forces measured by the thrust force measuring apparatuses become greater than a predetermined upper limit value.

6. The hot rolling mill according to claim 1, further comprising:

thrust force measuring apparatuses that measure thrust forces acting on shafts of the work rolls, wherein the control apparatus controls the work-roll horizontal actuators such that the angles of the work rolls relative to the backup rolls are changed when the thrust forces measured by the thrust force measuring apparatuses become smaller than a predetermined lower limit value.

7. The hot rolling mill according to claim 1, further comprising:

bending actuators that apply bending forces to the work rolls, wherein the work rolls satisfy a condition that $D_w/L_b$ is equal to or greater than 0.15 and equal to or smaller than 0.3 where $D_w$ is a diameter of the work rolls, and $L_b$ is a maximum strip width of a rolled material.

8. A hot rolling method performed by a hot rolling mill including:

a pair of upper and lower work rolls;

a pair of upper and lower backup rolls that support the work rolls, respectively;

work-roll horizontal actuators that move the work rolls in a horizontal direction;

backup-roll horizontal actuators that move the backup rolls in the horizontal direction; and a control apparatus that controls angle adjustment by the work-roll horizontal actuators, and angle adjustment by the backup-roll horizontal actuators, the hot rolling method comprising:

a step of adjusting angles of an upper-side pair of the upper work roll and the upper backup roll, and a lower-side pair of the lower work roll and the lower backup roll in a state where the upper-side pair is kept parallel and in a state where the lower-side pair is kept parallel to obtain a pair cross angle at which the upper-side pair and the lower-side pair cross each other such that the pair cross angle becomes equal to or greater than 0.2 degrees; and a step of adjusting the angles of the upper work roll and the lower work roll in a state where the angles of the upper backup roll and the lower backup roll are maintained.

* * * * *